US009988962B2

(12) United States Patent
Imai et al.

(10) Patent No.: US 9,988,962 B2
(45) Date of Patent: Jun. 5, 2018

(54) EXHAUST EMISSION CONTROL SYSTEM OF INTERNAL COMBUSTION ENGINE

(71) Applicant: TOYOTA JIDOSHA KABUSHIKI KAISHA, Toyota-shi, Aichi-ken (JP)

(72) Inventors: Daichi Imai, Sunto-gun (JP); Hiromasa Nishioka, Susono (JP); Kiyoshi Fujiwara, Susono (JP); Yoshio Yamashita, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 143 days.

(21) Appl. No.: 15/071,668

(22) Filed: Mar. 16, 2016

(65) Prior Publication Data

US 2016/0273436 A1 Sep. 22, 2016

(30) Foreign Application Priority Data

Mar. 17, 2015 (JP) ..... 2015-053898

(51) Int. Cl.

| | |
|---|---|
| ***F01N 11/00*** | (2006.01) |
| ***F01N 3/027*** | (2006.01) |
| ***F01N 9/00*** | (2006.01) |
| ***F01N 3/021*** | (2006.01) |
| ***F01N 3/023*** | (2006.01) |

(52) U.S. Cl.

CPC ..... *F01N 9/002* (2013.01); *F01N 3/021* (2013.01); *F01N 3/023* (2013.01); *F01N 3/027* (2013.01); *F01N 11/002* (2013.01); *F01N 2550/04* (2013.01); *F01N 2560/08* (2013.01); *F01N 2900/0408* (2013.01); *F01N 2900/0416* (2013.01); *F01N 2900/0422* (2013.01);

(Continued)

(58) Field of Classification Search

CPC ..... F01N 11/002; F01N 3/021; F01N 3/023; F01N 3/027; F01N 9/002; F01N 2550/04; F01N 2560/08; F01N 2900/0408; F01N 2900/0416; F01N 2900/0422; F01N 2900/08; F01N 2900/1406; F01N 2900/1606

See application file for complete search history.

(56) References Cited

U.S. PATENT DOCUMENTS 8,444,730 B2 * 5/2013 Zhang ..... F01N 3/0253 422/169

FOREIGN PATENT DOCUMENTS

| | | | |
|---|---|---|---|
| JP | 2010-144514 | 7/2010 | |
| JP | 2011-137445 | 7/2011 | |
| WO | WO 2005116413 A1 * | 12/2005 | ..... F01N 9/002 |

* cited by examiner

*Primary Examiner* — Brandon Lee

(74) *Attorney, Agent, or Firm* — Finnegan, Henderson, Farabow, Garrett & Dunner LLP

(57) ABSTRACT

An exhaust emission control system of an internal combustion engine may include a filter, a temperature raising device, a differential pressure detecting device, and an electronic control unit. The filter may include a first region as a part of the filter, and a second region as another part of the filter. The electronic control unit may be configured to calculate a first deposition amount such that a calculated deposition amount is larger as a proportion of a magnitude of the first differential pressure reduction amount to the length of the first oxidation period is larger. The electronic control unit may be configured to calculate an amount of the particulate matter deposited in the second region based on a length of the second oxidation period and a second differential pressure reduction amount.

14 Claims, 9 Drawing Sheets

(52) U.S. Cl.
CPC .. *F01N 2900/08* (2013.01); *F01N 2900/1406* (2013.01); *F01N 2900/1606* (2013.01)

EXHAUST EMISSION CONTROL SYSTEM OF INTERNAL COMBUSTION ENGINE

INCORPORATION BY REFERENCE

The disclosure of Japanese Patent Application No. 2015-053898, filed on Mar. 17, 2015, is incorporated herein by reference in its entirety.

BACKGROUND

1. Technical Field

Embodiments of the present disclosure relate to an exhaust emission control system of an internal combustion engine.

2. Description of Related Art

In an internal combustion engine, a filter may be provided in an exhaust passage, for curbing release of particulate matter (which will be called "PM") contained in exhaust gas to the outside. Since the PM in the exhaust gas can be trapped by and gradually deposited in the filter while the engine is operating, a filter regeneration process may be performed so as to prevent clogging of the filter. In a diesel engine, for example, an air-fuel ratio of exhaust gas may be generally kept on the lean side; therefore, unburned fuel can be supplied to the exhaust gas, to be oxidized by an oxidation catalyst, or the like, provided in the exhaust passage. This may increase the exhaust temperature, and oxidize and remove the deposited PM.

Generally, the filter can have a main body portion that extends along flow of exhaust gas, and the PM in the exhaust gas may be trapped in the main body portion. However, the state of deposition of the PM in the filter is not always uniform; the PM deposition amount may vary among location regions of the filter, depending on the temperature distribution in the filter caused by flow of exhaust gas, changes in the load of the engine with time, and so forth. The variations in the PM deposition amount among local regions of the filter may cause an excessive rise in the temperature of the filter during the filter regeneration process, which may undesirably result in deterioration of the filter, for example. Thus, according to a technology described in Japanese Patent Application Publication No. 2011-137445 (JP 2011-137445 A), two or more sets of electromagnetic-wave transmitting and receiving means can be arranged in a direction of exhaust flow in the filter, and spatial distribution (variations) of the PM deposition amount in the filter can be measured by using detection results of the above means.

SUMMARY

If the measurement method using electromagnetic waves as described above is employed, it may be necessary to install devices for transmitting and receiving electromagnetic waves in the vicinity of the filter, which may result in complex design of the exhaust system of the engine, and increased manufacturing cost.

Embodiments of the present disclosure allow for calculating PM deposition amounts in local regions of a filter.

The oxidation rate of the PM in a partial region of the filter for which the local PM deposition amount is to be calculated, while the temperature of the filter is rising, can be focused on. The PM oxidation rate may have a correlation with the PM deposition amount in the partial region. Therefore, the PM deposition amount in the partial region can be calculated from the PM oxidation rate in the partial region, based on the above-mentioned correlation. Thus, according to embodiments of the present disclosure, the length of the oxidation period in the course of rising of the filter temperature, and an exhaust differential pressure between the upstream side and downstream side of the filter may be specified as parameters relating to the PM oxidation rate in the partial region.

An exhaust emission control system of an internal combustion engine according to one aspect of the present disclosure may include a filter, a temperature raising device, a differential pressure detecting device, and an electronic control unit. The filter may be provided in an exhaust passage of the internal combustion engine. The filter may be configured to trap particulate matter in exhaust gas. The filter may include a first region as a part of the filter, and a second region as another part of the filter. The temperature raising device may be configured to raise a temperature of the filter from an upstream side. The differential pressure detecting device may be configured to detect an exhaust pressure difference between the exhaust passage upstream of the filter and the exhaust passage downstream of the filter. The electronic control unit may be configured to perform a prescribed temperature raising process to raise a temperature of the filter such that a part of the particulate matter deposited in the first region and the second region of the filter is oxidized. The electronic control unit may be configured to calculate, as a first differential pressure reduction amount, a reduction amount of the exhaust pressure difference detected by the differential pressure detecting device, during execution of the prescribed temperature raising process, in a first oxidation period as at least a part of a period from a point in time at which a temperature of the first region exceeds a predetermined oxidation start temperature at which the particulate matter deposited in the filter starts being oxidized, to a point in time at which a temperature of the second region exceeds the predetermined oxidation start temperature. The electronic control unit may be configured to calculate an amount of the particulate matter deposited in the first region, as a first deposition amount, based on a length of the first oxidation period and the first differential pressure reduction amount. The electronic control unit may be configured to calculate the first deposition amount such that the calculated deposition amount is larger as a proportion of a magnitude of the first differential pressure reduction amount to the length of the first oxidation period is larger. The electronic control unit may be configured to calculate, as a second differential pressure reduction amount, a reduction amount of the exhaust pressure difference detected by the differential pressure detecting device, during execution of the prescribed temperature raising process, in a second oxidation period after the temperature of the second region exceeds the predetermined oxidation start temperature. The electronic control unit may be configured to calculate an amount of the particulate matter deposited in the second region, as a second deposition amount, based on a length of the second oxidation period and the second differential pressure reduction amount. The electronic control unit may be configured to calculate the second deposition amount such that the calculated second deposition amount is larger as a proportion of a magnitude of a second region partial reduction amount corresponding to a differential pressure reduction amount for the second region, out of the second differential pressure reduction amount, to the length of the second oxidation period is larger.

In the exhaust emission control system of the internal combustion engine according to embodiments of the present disclosure, the filter may be provided in the exhaust passage of the engine, for trapping the PM contained in exhaust gas.

The filter may include at least the first region and the second region, as partial regions that constitute the filter and are located along the direction of exhaust flow. In the filter, the second region may be located downstream of the first region, and a partial region(s) other than these regions may be included in the filter. Also, the first region and the second region may be preferably located adjacent to each other. The temperature of the first region and the temperature of the second region are typical temperatures of the respective regions, though, some temperature distribution may be microscopically formed in each region. The typical temperatures of the respective regions may be set by various methods. For example, the temperature measured at a central point of each region as viewed in the direction of exhaust flow may be set as a typical temperature of the region. In another method, the temperature of a point, other than the central point, preferably at an equivalent position in each region, may be set as a typical temperature of each region.

The temperature raising device may perform the prescribed temperature raising process for raising the temperature of the filter from the upstream side. Accordingly, if the prescribed temperature raising process is performed, the temperature of the first region on the upstream side in the filter may be initially raised, and the temperature of the second region may be subsequently raised. Here, the prescribed temperature raising process may be a process of raising the temperature of the filter, so as to calculate the amounts of PM deposited in the first region and the second region as will be described later, namely, to calculate the amounts of PM locally deposited in the filter. For the sake of the calculation, the temperature of the filter can be raised so that only a part of the PM deposited in each region of the filter is oxidized and burned. As a specific temperature raising device for the prescribed temperature raising process, various known temperature raising devices may be employed. For example, where an oxidation catalyst is located upstream of the filter, or the oxidation catalyst is supported in the filter, combustion conditions of the internal combustion engine may be controlled so that unburned fuel components are included in exhaust gas, whereby the temperature raising device can raise the temperature of the filter, using oxidative heat produced by oxidation of the unburned fuel components. In another embodiment, a valve that permits fuel to be added to exhaust gas in the exhaust passage may be provided, so that the temperature raising device can raise the temperature of the filter, using oxidative heat of the fuel thus added. As a further embodiment, the temperature raising device may raise the temperature of the filter, by means of a heater or a burner provided adjacent to an upstream end face of the filter. With any of the above-indicated temperature raising devices, the prescribed temperature raising process may not be a process for oxidizing and burning the PM deposited in the filter as a whole, but a process for oxidizing and burning only a part of the deposited PM in each region of the filter.

In the exhaust emission control system according to embodiments of the present disclosure, the electronic control unit may calculate the first deposition amount as the amount of the PM deposited in the first region as a part of the filter, and may calculate the second deposition amount as the amount of the PM deposited in the second region as a part of the filter. In calculation of the respective PM deposition amounts by the electronic control unit, a correlation between the oxidation rate of the PM in each region and the PM deposition amount in each region, while the prescribed temperature raising process is being performed, may be taken into consideration.

Initially, the electronic control unit may calculate the first deposition amount in the first region. Once the prescribed temperature raising process is executed, the temperature of the first region located on the upstream side may be raised earlier than that of the second region, and may reach and exceed the predetermined oxidation start temperature first. The predetermined oxidation start temperature can be a temperature at which the PM deposited in the filter starts being oxidized, and can be set as needed by experiment in advance, or according to general technical knowledge, for example. As the prescribed temperature raising process proceeds, the temperature of the second region may reach and may exceed the predetermined oxidation start temperature, after the temperature of the first region exceeds the oxidation start temperature. During the period from the time when the temperature of the first region exceeds the predetermined oxidation start temperature to the time when the temperature of the second region exceeds the predetermined oxidation start temperature, oxidation and combustion of the deposited PM may proceed in the first region of the filter, but oxidation and combustion of the deposited PM may not proceed in the second region. Thus, at least a part of this period may be regarded as the first oxidation period.

The temperatures of the first region and second region in the filter may be estimated based on the amount of heat supplied to the filter by the prescribed temperature raising process, and various conditions (such as the heat capacity of the filter, and the flow rate of exhaust gas) relating to propagation of heat in the filter. In another embodiment of the present disclosure, sensors for temperature detection may be provided in the first region and the second region, and the temperature of these regions may be respectively detected by these sensors.

The first differential pressure reduction amount in the first oxidation period may reflect the amount of reduction of the deposited PM due to oxidation and combustion of the deposited PM in the first region through the prescribed temperature raising process. Further, if the length of the first oxidation period in which the first differential pressure reduction amount appears is taken into consideration, the proportion (which will also be called "first proportion") of the magnitude of the first differential pressure reduction amount to the length of the first oxidation period may reflect the oxidation rate of the deposited PM in the first region in the prescribed temperature raising process. Since the oxidation rate of the deposited PM in the filter can be correlated with the amount of the deposited PM, the electronic control unit can calculate the first deposition amount in the first region, based on the first proportion. More specifically, since the oxidation rate of the deposited PM may increase as the deposited PM amount increases, the electronic control unit can calculate the first deposition amount so that the first deposition amount increases as the first proportion is larger. The first deposition amount calculated by the electronic control unit may be calculated based on the oxidation rate of the deposited PM; therefore, the first deposition amount may be said to be the deposition amount at the time of execution of the prescribed temperature raising process in which the deposited PM is oxidized.

Next, calculation of the second deposition amount in the second region by the electronic control unit will be described. In the second oxidation period after the temperature of the second region exceeds the predetermined oxidation start temperature while the prescribed temperature raising process is being performed, oxidation and combustion of the deposited PM may also proceed in the second region, and oxidation and combustion of the deposited PM may be continued in the first region located on the upstream side. Accordingly, in the second oxidation period, the deposited PM in the first region and the second region can be oxidized and burned through the prescribed temperature raising process.

Accordingly, the second differential pressure reduction amount in the second oxidation period may reflect the amount of reduction of the deposited PM due to oxidation and combustion of the deposited PM in the first region and the second region through the prescribed temperature raising process. Thus, the amount of reduction in the differential pressure due to oxidation and combustion of the deposited PM present in the second region, out of the second differential pressure reduction amount, can be referred to as the second region partial reduction amount. Then, the proportion (which will also be called "second proportion") of the magnitude of the second region partial reduction amount to the length of the second oxidation period may reflect the oxidation rate of the deposited PM in the second region in the prescribed temperature raising process. Thus, since the oxidation rate of the deposited PM may increase as the deposited PM amount is larger, the electronic control unit may calculate the second deposition amount so that the second deposition amount increases as the second proportion is larger. The second deposition amount calculated by the electronic control unit may be calculated based on the oxidation rate of the deposited PM; therefore, the second deposition amount may be said to be the deposition amount at the time of execution of the prescribed temperature raising process in which the deposited PM is oxidized.

In the exhaust emission control system according to embodiments of the present disclosure, the electronic control unit may be configured to set the second oxidation period such that the first oxidation period and the second oxidation period have a same length of time. The electronic control unit may be configured to calculate the second region partial reduction amount based on a difference between the second differential pressure reduction amount and the first differential pressure reduction amount. If the second oxidation period is set to the same length as the first oxidation period, the amount of the deposited PM oxidized in the first region during the second oxidation period can be regarded as being substantially equal to the amount of the deposited PM oxidized in the first region during the first oxidation period. Thus, the amount of reduction in differential pressure caused by the deposited PM in the first region, out of the second differential pressure reduction amount, can be regarded as being equal to the first differential pressure reduction amount; therefore, the second region partial reduction amount can be calculated based on a differential pressure reduction amount obtained by subtracting the first differential pressure reduction amount from the second differential pressure reduction amount.

In another embodiment of the present disclosure, if the oxidation/combustion speed of the deposited PM in the first region during the first oxidation period is considered to be substantially equal to the oxidation/combustion speed of the deposited PM in the first region during the second oxidation period, the amount of reduction in the differential pressure due to oxidation and combustion of the deposited PM in the first region during the second oxidation period can be calculated by multiplying the first differential pressure reduction amount by the ratio of the length of the second oxidation period to the length of the first oxidation period. Then, the second region partial reduction amount can be calculated by subtracting the result of the multiplication from the second differential pressure reduction amount.

Thus, in the exhaust emission control system of the internal combustion engine as described above, the deposited PM amounts of the first region and the second region into which the filter is divided in the direction of exhaust flow can be calculated using the prescribed temperature raising process of the filter and the exhaust pressure difference between the upstream side and downstream side of the filter. The prescribed temperature raising process in the filter can normally utilize the arrangement associated with the process for oxidizing and removing the deposited PM in the filter, and the above-mentioned exhaust differential pressure is a parameter that is widely used in exhaust emission control systems having filters. Accordingly, the exhaust emission control system is able to favorably calculate the PM deposition amounts of local regions in the filter, by a simple method.

In the exhaust emission control system according to embodiments of the present disclosure, when the length of the first oxidation period is set to be a fixed length of time, upon calculation of the first deposition amount, the denominator in the first proportion can become a fixed value, and therefore, the magnitude of the first differential pressure reduction amount may be directly reflected by the oxidation rate of the deposited PM in the first region during the first oxidation period. Similarly, when the length of the second oxidation period is set to be a fixed length of time, upon calculation of the second deposition amount, the denominator in the second proportion can become a fixed value, and therefore, the magnitude of the second region partial reduction amount may be directly reflected by the oxidation rate of the deposited PM in the second region during the second oxidation period. In the exhaust emission control system according to embodiments of the present disclosure, when the first oxidation period is set to a fixed length of time, the electronic control unit may be configured to calculate the first deposition amount such that the calculated first deposition amount is larger as the first differential pressure reduction amount is larger. When the second oxidation period is set to a fixed length of time, the electronic control unit may be configured to calculate the second deposition amount such that the calculated second deposition amount is larger as the second region partial reduction amount is larger. The length of the first oxidation period and the length of the second oxidation period are not always required to be equal to each other.

In the exhaust emission control system according to embodiments of the present disclosure, the electronic control unit may be configured to control the temperature raising device such that an amount of heat supplied to the filter per unit time by the prescribed temperature raising process in the first oxidation period is equal to an amount of heat supplied to the filter per unit time by the prescribed temperature raising process in the second oxidation period. Namely, when the first deposition amount in the first region and the second deposition amount in the second region are calculated, a condition of the amount of heat supplied to the filter by the prescribed temperature raising process may be made constant. In this manner, in calculation of each deposition amount, an oxidation condition of the deposited PM in the first region and an oxidation condition of the deposited PM in the second region can be made as close as possible, and the accuracy in calculation of each deposition amount can be enhanced.

In the exhaust emission control system according to embodiments of the present disclosure, the electronic control unit may be configured to estimate an amount of the particulate matter deposited in the filter as a whole, based on operating conditions of the internal combustion engine. The electronic control unit may be configured to control the temperature raising device as a filter regeneration process, when the amount of the particulate matter deposited in the filter as a whole exceeds a regeneration reference amount, such that the temperature of the filter is raised, and the particulate matter is oxidized and removed. The electronic control unit may be configured to execute the prescribed temperature raising process when the amount of the particulate matter deposited in the filter as a whole exceeds a partial calculation reference amount that is smaller than the regeneration reference amount. The electronic control unit may be configured to execute the filter regeneration process even if the amount of the particulate matter deposited in the filter as a whole does not exceed the regeneration reference amount, when the first deposition amount exceeds a first reference deposition amount, or the second deposition amount exceeds a second reference deposition amount.

In the exhaust emission control system of embodiments of the present disclosure, the electronic control unit may perform the filter regeneration process for oxidizing and removing the PM deposited in the filter, based on the amount of the PM deposited in the filter as a whole. At a point in time before the filter regeneration process is executed, namely, when the PM deposition amount of the filter as a whole exceeds the partial calculation reference amount, the first deposition amount and the second deposition amount as the local PM deposition amounts in the first region and the second region at this point in time may be calculated. Then, the calculated first deposition amount and second deposition amount may be compared with the corresponding first reference deposition amount and second reference deposition amount, respectively. Here, the first reference deposition amount and the second reference deposition amount may be PM deposition amounts based on which it is determined that there is a possibility of an excessive rise in the temperature of a local region in the filter due to a large amount of PM deposited in the local region, if the filter regeneration process is not performed even in a condition where the PM deposition amount in the first region or the PM deposition amount in the second region exceeds the corresponding reference deposition amount, and the filter regeneration process is then performed on the basis of the PM deposition amount in the filter as a whole. Further, the first reference deposition amount and the second reference deposition amount may be set to PM deposition amounts that do not cause a local, excessive rise in the temperature in each region, even if the filter regeneration process is performed when the PM deposition amounts in the respective regions are the first reference deposition amount and the second reference deposition amount. For example, the first reference deposition amount and the second reference deposition amount may be set to values obtained by multiplying the regeneration reference amount set with respect to the filter as a whole, by the proportions of the respective capacities of the first region and the second region to the capacity of the filter as a whole. Thus, in the exhaust emission control system of embodiments of the present disclosure, the filter regeneration process may be executed when the first deposition amount exceeds the first reference deposition amount, or the second deposition amount exceeds the second reference deposition amount, even though the deposition amount of the filter as a whole has not reached the regeneration reference amount. Namely, the filter regeneration process is executed at an earlier opportunity.

In the exhaust emission control system according to embodiments of the present disclosure, the electronic control unit may be configured to estimate an amount of the particulate matter deposited in the filter as a whole, based on operating conditions of the internal combustion engine. The electronic control unit may be configured to execute the prescribed temperature raising process, when the amount of the particulate matter deposited in the filter as a whole exceeds a regeneration reference amount. The electronic control unit may be configured to control the temperature raising device as a filter regeneration process, following execution of the prescribed temperature raising process, when the first deposition amount does not exceed a third reference deposition amount, and the second deposition amount does not exceed a fourth reference deposition amount, such that the temperature of the filter is raised, and the particulate matter is oxidized and removed.

In the exhaust emission control system of embodiments of the present disclosure, when an execution condition of the filter regeneration process is satisfied, namely, when the PM deposition amount of the filter as a whole exceeds the regeneration reference amount, the first deposition amount and the second deposition amount as the local PM deposition amounts in the first region and the second region at this time are calculated before the filter regeneration process. Then, if both of the first deposition amount and the second deposition amount do not exceed the corresponding third reference deposition amount and fourth reference deposition amount, respectively, it can be determined that there is no possibility of an excessive rise in the temperature of a local region of the filter even if the filter regeneration process is subsequently performed. In this case, the filter regeneration process starts being executed, following the prescribed temperature raising process performed for calculation of the first deposition amount, etc. Thus, it is possible to perform the filter regeneration process on the filter, of which the temperature has been raised to some extent by the prescribed temperature raising process, while curbing occurrence of an excessive rise in the temperature during the filter regeneration process. Thus, the energy required for the filter regeneration process, namely, the amount of energy required for oxidizing and removing the PM deposited in the filter as a whole, can be reduced.

In the exhaust emission control system of embodiments of the present disclosure, the electronic control unit may be configured to control the temperature raising device as a slow filter regeneration process, when at least the first deposition amount exceeds the third reference deposition amount, or the second deposition amount exceeds the fourth reference deposition amount, such that the amount of heat supplied to the filter is smaller than that of the filter regeneration process, as an excess amount of the first deposition amount relative to the third reference deposition amount is larger, or an excess amount of the second deposition amount relative to the fourth reference deposition amount is larger. Namely, when there is a possibility of an excessive rise in the temperature of the filter due to a large amount of PM deposited in a local region of the filter, a slow filter regeneration process, which is different from the above-described filter regeneration process, may be performed. In the slow filter regeneration process, the amount of heat supplied to the filter per unit time can be controlled according to the possibility of the excessive rise in the temperature, namely, according to the above-indicated excess amount. With this process, the time required to remove the PM deposited in the filter as a whole may be prolonged, but the oxidation and removal of the deposited PM can be accomplished while the otherwise possible excessive rise in the temperature of the filter is curbed as much as possible.

In the exhaust emission control system of embodiments of the present disclosure, the electronic control unit may be configured to estimate an estimated first deposition amount as an amount of the particulate matter deposited in the first region, and an estimated second deposition amount as an amount of the particulate matter deposited in the second region, based on operating conditions of the internal combustion engine. The electronic control unit may be configured to estimate an amount of the particulate matter deposited in the filter as a whole, based on the operating conditions of the internal combustion engine. The electronic control unit may be configured to control the temperature raising device as a filter regeneration process such that the temperature of the filter is raised, and the particulate matter is oxidized and removed, when the amount of the particulate matter deposited in the filter as a whole exceeds a regeneration reference amount. The electronic control unit may be configured to execute the prescribed temperature raising process when a predetermined time elapses from completion of the filter regeneration process. The electronic control unit may be configured to correct the estimated first deposition amount and the estimated second deposition amount, based on the first deposition amount and the second deposition amount.

In the exhaust emission control system of embodiments of the present disclosure, the estimated first deposition amount and the estimated second deposition amount may be estimated based on the operating conditions of the internal combustion engine. This estimation may be independent of calculation of the first deposition amount and the second deposition amount. The estimated first deposition amount and the estimated second deposition amount can be used for various purposes in the exhaust emission control system. For example, the estimated first and second deposition amounts may be used in the filter regeneration process as described above, a process for determining clogging of the filter, and so forth.

Since the estimated first deposition amount and the estimated second deposition amount may be estimated based on operating conditions of the internal combustion engine, the PM deposition amounts of local regions in the filter can be obtained by a further simpler method, as compared with calculation of the first deposition amount and the second deposition amount involving the prescribed temperature raising process. On the other hand, the estimation accuracy is highly likely to be reduced depending on conditions, such as when operating conditions of the engine fluctuate. To improve the estimation accuracy as much as possible, the estimation results may be corrected, using the calculated first deposition amount and second deposition amount. The first deposition amount and second deposition amount used for correcting the estimation results may be calculated when a predetermined time elapses from completion of the filter regeneration process. This is because, in the calculation of the first deposition amount and the second deposition amount, there may be a need to partially oxidize and burn the PM deposited in the first region and the second region, so that the oxidation and combustion are reflected by the exhaust differential pressure; therefore, certain amounts of PM may be deposited in the first region and the second region, so that the reflection can be accurately achieved. Thus, the above-indicated predetermined time may be set to a length of time required to form a condition where certain amounts of PM are deposited.

In the exhaust emission control system as described above, the filter may further include a third region as a part of the filter located downstream of the second region. The electronic control unit may be configured to set the second oxidation period such that the second oxidation period is at least a part of a period from a point in time at which the temperature of the second region exceeds the predetermined oxidation start temperature, to a point in time at which a temperature of the third region exceeds the predetermined oxidation start temperature, during execution of the prescribed temperature raising process. The electronic control unit may be configured to calculate, as a third differential pressure reduction amount, a reduction amount of the exhaust pressure difference detected by the differential pressure detecting device, in a third oxidation period after the temperature of the third region exceeds the predetermined oxidation start temperature, during execution of the prescribed temperature raising process. The electronic control unit may be configured to calculate an amount of the particulate matter deposited in the third region as a third deposition amount, based on a length of the third oxidation period and the third differential pressure reduction amount. The electronic control unit may be configured to calculate the third deposition amount, such that the calculated third deposition amount is larger as a proportion of a magnitude of a third region partial reduction amount corresponding to a differential pressure reduction amount for the third region, out of the third differential pressure reduction amount, to the length of the third oxidation period, is larger.

Embodiments of the present disclosure with respect to calculation of the PM deposition amounts in two regions may be applied to calculation of the PM deposition amounts in three regions of the filter. For example, in the exhaust emission control system of the internal combustion engine as described above, when the first oxidation period is set to a fixed length of time, the first deposition amount may be calculated so as to be larger as the first differential reduction amount is larger. When the second oxidation period is set to a fixed length of time, the second deposition amount may be calculated so as to be larger as the second region partial reduction amount is larger. When the third oxidation period is set to a fixed length of time, the third deposition amount may be calculated so as to be larger as the third region partial reduction amount is larger.

In the exhaust emission control system of the internal combustion engine as described in embodiments of the present disclosure, when all of the first oxidation period, second oxidation period, and the third oxidation period are set to the same length of time, the second region partial reduction amount may be calculated based on a difference between the second differential pressure reduction amount and the first differential pressure reduction amount, and the third region partial reduction amount may be calculated based on a difference between the third differential pressure reduction amount and the second differential pressure reduction amount. Also, the amount of heat supplied to the filter per unit time by the prescribed temperature raising process in the first oxidation period, the amount of heat supplied to the filter per unit time by the prescribed temperature raising process in the second oxidation period, and the amount of heat supplied to the filter per unit time by the prescribed temperature raising process in the third oxidation period may be set to the same amount.

In the exhaust emission control system of the internal combustion engine as described in embodiments of the present disclosure, when the filter is divided into the first region and the second region, the first region may be an upstream-side region of the filter, and the second region may be a downstream-side region of the filter. When the filter is divided into the first region, second region, and the third region, the first region may be an upstream-side region of the filter, and the second region may be a middle region of the filter, while the third region may be a downstream-side region of the filter.

According to the present disclosure, the local PM deposition amounts in the filter may be calculated.

BRIEF DESCRIPTION OF THE DRAWINGS

Embodiments of the present disclosure will be described below with reference to the accompanying drawings, in which like numerals denote like elements, and wherein.

DETAILED DESCRIPTION

Embodiments of the present disclosure will be described with reference to the drawings. The dimensions, materials, shapes, relative positions, etc. of constituent components described in the embodiments are not intended to limit the scope of the present disclosure.

Figure 1A:
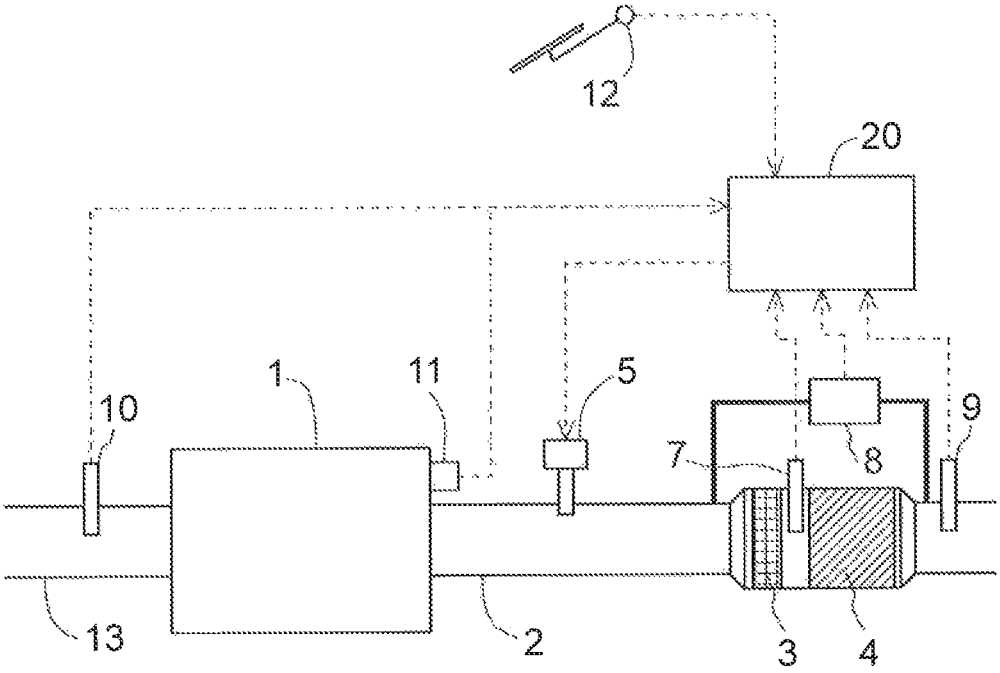
FIG. 1A shows the general configuration of an exhaust emission control system of an internal combustion engine according to the embodiments of the present disclosure.

FIG. 1A shows the general configuration of an exhaust emission control system of an internal combustion engine 1 according to embodiments of the present disclosure. The internal combustion engine 1 is a diesel engine for driving a vehicle. An exhaust passage 2 is connected to the engine 1. A particulate filter 4 (which will be simply called "filter") for trapping PM (particulate matter) in exhaust gas is provided in the exhaust passage 2. The filter 4 is a wall flow type filter, and an oxidation catalyst is supported on its substrate. A heater 3 is located upstream of the filter 4 in the exhaust passage 2, such that the heater 3 almost adjoins an upstream end face of the filter 4. The heater 3 is arranged to be able to heat the upstream end face of the adjoining filter 4. More specifically, electric power is supplied from an external power supply to the heater 3, which in turn supplies thermal energy to the upstream end face of the filter 4, so as to raise the temperature of the filter 4 from the upstream side. While the heater 3 is located on the upstream side of the filter 4, its shape and installation position are adjusted so that the heater 3 does not hamper or interrupt flow of exhaust gas into the filter 4.

A fuel supply valve 5 that supplies fuel (unburned fuel) into exhaust gas flowing into the filter 4 is provided on the upstream side of the heater 3. Also, a temperature sensor 7 is installed at a position where it can detect the temperature of exhaust gas flowing into the filter 4, namely, in the exhaust passage 2 between the heater 3 and the filter 4, and a temperature sensor 9 that detects the temperature of exhaust gas flowing in the exhaust passage 2 downstream of the filter 4 is installed. Further, a differential pressure sensor 8 that detects a difference in the exhaust pressure (which will also be simply called "exhaust differential pressure") between upstream and downstream portions of the exhaust passage 2 on the opposite sides of the filter 4 is provided.

In an intake passage 13 of the internal combustion engine, an air flow meter 10 capable of measuring the flow rate of intake air flowing in the intake passage 13 is installed. The internal combustion engine 1 is equipped with an electronic control unit (ECU) 20, which is a unit for controlling operating conditions, etc. of the engine 1. The above-described fuel supply valve 5, temperature sensors 7, 9, differential pressure sensor 8, air flow meter 10, crank position sensor 11, accelerator pedal position sensor 12, and so forth are electrically connected to the ECU 20. The fuel supply valve 5 supplies fuel to exhaust gas, according to a command from the ECU 20, and detection values obtained by the respective sensors are transmitted to the ECU 20. For example, the crank position sensor 11 detects the crank angle of the engine 1, and sends it to the ECU 20, and the accelerator pedal position sensor 12 detects the accelerator pedal position or operation amount of the vehicle on which the engine 1 is installed, and sends it to the ECU 20. As a result, the ECU 20 derives the engine speed of the engine 1 from the detection value of the crank position sensor 11, and derives the engine load of the engine 1 from the detection value of the accelerator pedal position sensor 12. Also, the ECU 20 detects the temperature of exhaust gas flowing into the filter 4, based on the detection value of the temperature sensor 7, and can estimate the temperature of the filter 4 based on the detection value of the exhaust temperature sensor 9. Also, the ECU 20 is able to detect the exhaust differential pressure via the differential pressure sensor 8. Also, the ECU 20 can obtain the exhaust flow rate, based on the detection value of the air flow meter 10 and the fuel injection amount. The ECU 20 may be programmed to perform functions and processes disclosed herein.

Figure 1B:
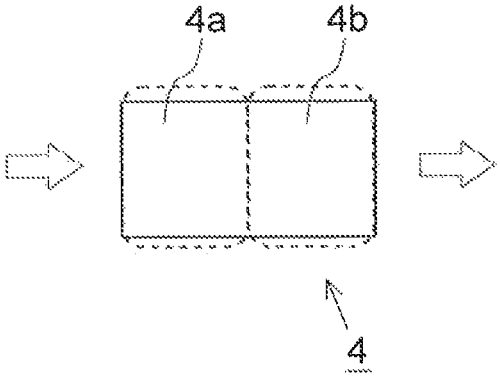
FIG. 1B shows a filter of the exhaust emission control system shown in FIG. 1A.

In this embodiment, as shown in FIG. 1B, the filter 4 is divided into a front region 4*a* located on the upstream side in a direction of exhaust flow, and a rear region 4*b* located on the downstream side, and a partial deposition amount of PM in each of the regions is calculated. In FIG. 1B, blank arrows indicate flow of exhaust gas. The amount of PM deposited in the front region 4*a* will be called "front-region deposition amount PM_Fr", and the amount of PM deposited in the rear region 4*b* will be called "rear-region deposition amount RM_Rr".

In the exhaust emission control system of the internal combustion engine 1 constructed as described above, PM contained in exhaust gas is generally trapped by the filter 4, and its release to the outside of the vehicle is curbed. In addition, a catalyst for cleaning exhaust gas (such as a catalyst for removing NOx) that is not illustrated in the drawings may be provided. In this embodiment, the filter 4 is a wall flow type filter, and an oxidation catalyst having an oxidizing capability, such as a platinum group metal PGM, is supported on the substrate of the filter 4. The oxidation catalyst is supported on inner wall surfaces of the filter and within fine pores of the filter substrate, over a range from the upstream end to the downstream end thereof. Owing to the oxidizing capability of the oxidation catalyst, unburned fuel and NO in the exhaust gas can be oxidized. With NO thus oxidized and turned into $NO_2$, it is possible to promote oxidation and removal of PM deposited in the filter 4, using the oxidizing capability of $NO_2$ itself.

If the amount of PM deposited in the filter 4 reaches the limit deposition amount or maximum permissible amount for the filter 4, the back pressure in the exhaust passage 2 increases; therefore, the temperature of the filter 4 is raised so as to oxidize and remove the PM deposited in the filter 4. A process for oxidizing and removing PM will be called "filter regeneration process" in this specification. More specifically, in the filter regeneration process, a certain amount of fuel is supplied from the fuel supply valve 5 into exhaust gas, and is oxidized by the oxidation catalyst supported on the filter 4, so that the temperature of the filter 4 is raised, whereby the PM deposited in the filter 4 is oxidized and removed.

In some cases, even when unburned fuel is supplied from the fuel supply valve 5 in the filter regeneration process, and the unburned fuel is oxidized by the oxidation catalyst supported on the front region 4*a*, the oxidation reaction heat is likely to be transferred to the downstream side due to flow of exhaust gas, depending on the flow rate of exhaust gas flowing in the filter 4, and the temperature of the front region 4*a* itself may be less likely or unlikely to be kept at a temperature level that permits oxidation and removal of the deposited PM. Accordingly, even if the filter regeneration process is performed, some PM may remain unburned in the front region 4*a*, and a larger amount of deposited PM may locally exist in the front region 4*a* than in the rear region 4*b*, in the course of PM trapping by the filter 4. In other cases, when the filter regeneration process is executed, but the same process is finished before heat is sufficiently transferred to the rear region 4*b*, depending on a condition of exhaust flow in the filter 4, a larger amount of deposited PM may locally exist in the rear region 4*b* than in the front region 4*a*, in the course of PM trapping by the filter 4.

Namely, even if the filter regeneration process is performed in the filter 4, the distribution of PM deposited in the filter 4 may vary depending on various conditions. In particular, if the filter regeneration process is performed, in a condition where the deposition amount in the filter 4 as a whole is relatively small but a large amount of PM is locally deposited in a certain region of the filter 4, the filter temperature may be excessively raised locally in this region, resulting in concerns about deterioration of the filter itself and deterioration of the oxidation catalyst, for example. Thus, in this embodiment, local PM deposition amounts in the filter 4, i.e., the PM deposition amount in the front region 4*a* and the PM deposition amount in the rear region 4*b*, are calculated, and the filter regeneration process is performed in view of the local PM deposition amounts.

Figure 2A:
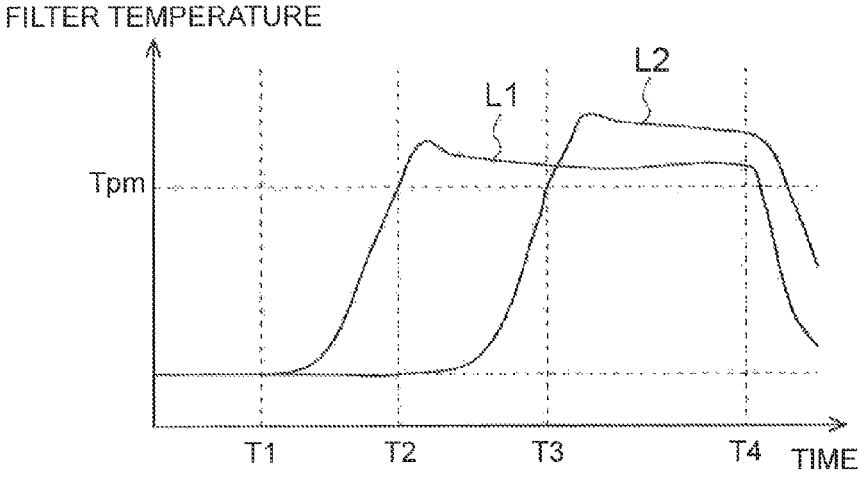
FIG. 2A shows changes in the filter temperature with time due to a temperature raising process performed when calculating partial PM deposition amounts of the filter, when the filter is divided into two regions, in the exhaust emission control system shown in FIG. 1A.
Figure 2B:
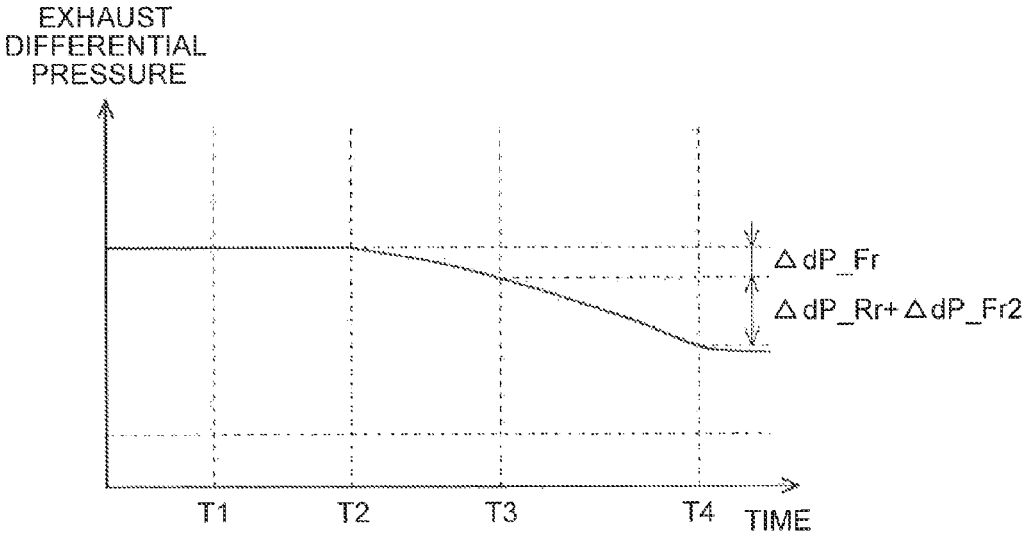
FIG. 2B shows changes in an exhaust differential pressure with time as a difference of exhaust pressures upstream and downstream of the filter, when the filter is divided into two regions, in the exhaust emission control system shown in FIG. 1A.
Figure 3A:
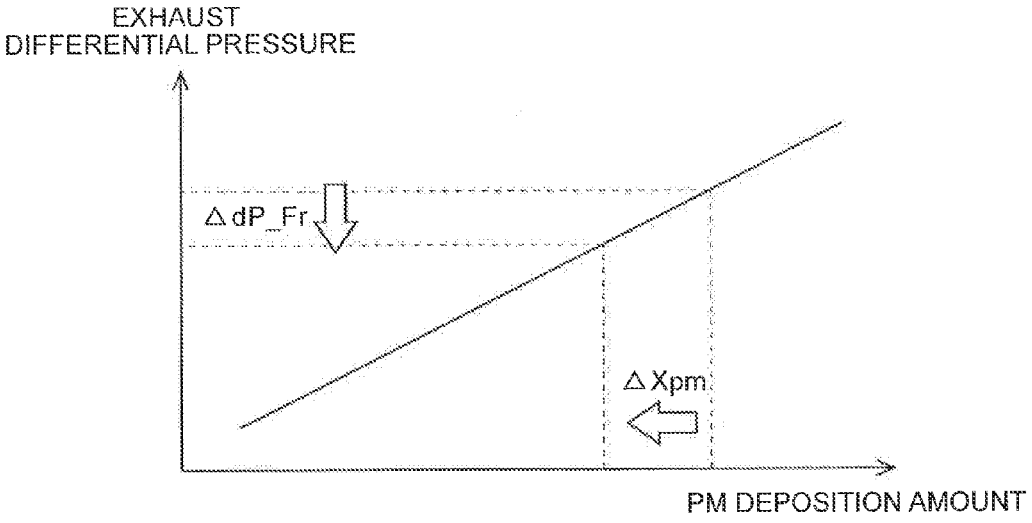
FIG. 3A shows a correlation between the PM deposition amount of the filter as a whole and the exhaust differential pressure detected by a differential pressure sensor.
Figure 3B:
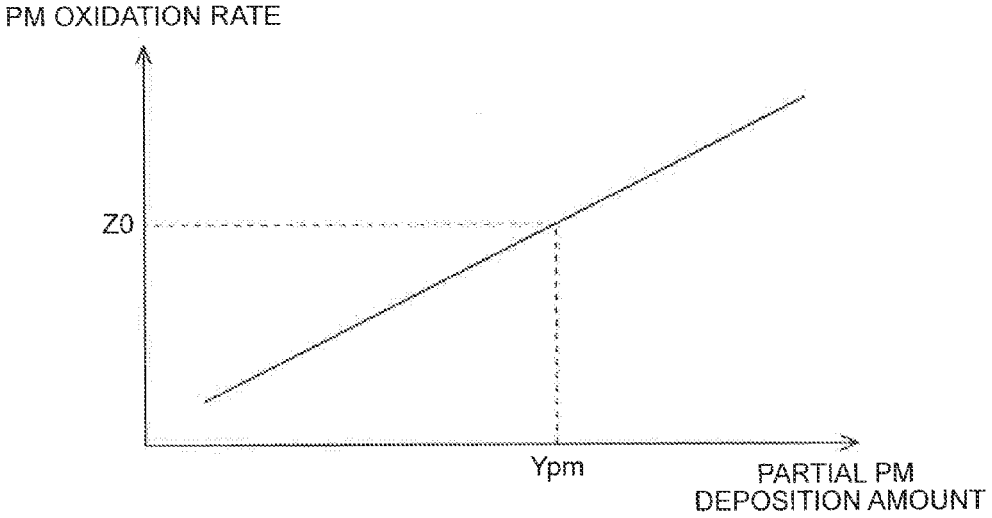
FIG. 3B shows a correlation between the partial PM deposition amount of the filter and the oxidation rate of deposited PM.

Referring to FIG. 2A, FIG. 2B, FIG. 3A and FIG. 3B, calculation of the PM deposition amount in the front region 4*a* and the PM deposition amount in the rear region 4*b* will be described. In this embodiment, the PM deposition amount in the front region 4*a* and the PM deposition amount in the rear region 4*b* may be called "partial deposition amounts", so as to be distinguished from the PM deposition amount in the filter 4 as a whole. FIG. 2A shows changes in the temperature of each region with time during a temperature raising process (which will be called "calculation-time temperature raising process") performed on the filter 4 when the PM deposition amount in each region is calculated, and FIG. 2B shows changes in the detection value of the differential pressure sensor 8 with time during the same process. FIG. 3A and FIG. 3B are views useful for explaining the logic of the PM deposition amount in each region. FIG. 3A generally indicates a correlation between the PM deposition amount in the filter 4 as a whole and the exhaust differential pressure detected by the differential pressure sensor 8. FIG. 3B generally indicates a correlation between the PM deposition amount in the filter 4 and the oxidation rate of the deposited PM.

To calculate the PM deposition amount in each region, the calculation-time temperature raising process as described above is performed. In this process, the temperature of the filter 4 is raised from the upstream side, and a part of the PM deposited in each region of the filter is oxidized and burned through elevation of the temperature. More specifically, the upstream-side end face of the filter 4 is heated by the heater 3, so that the calculation-time temperature raising process is executed. At this time, the amount of energy supplied from the heater 3 for heating of the filter 4 is controlled, so that the deposited PM can be oxidized and burned, as described above.

In FIG. 2A, line L1 indicates changes in the temperature of the front region 4*a* with time when the calculation-time temperature raising process is performed, and line L2 indicates changes in the temperature of the rear region 4*b* with time. As the changes in the temperature of each region, changes in the temperature measured at a representative point of each region are estimated by the ECU 20, based on the amount of heat supplied from the heater 3 to the filter 4 through the calculation-time temperature raising process, and various parameters (such as the heat capacity of the filter 4, the flow rate of exhaust gas flowing through the filter 4, and the heat radiation coefficient of the filter 4) related to thermal propagation in the filter 4. The representative point in this embodiment is a central point of each of the front region 4*a* and the rear region 4*b* as viewed in the exhaust flow direction. In another method, the temperature of each region may be directly measured by a temperature sensor embedded in each region.

More specifically, the calculation-time temperature raising process is started at time T1, and the temperature of the front region 4*a* located on the upstream side starts rising. At this time, most of the heat has not been transferred to the rear region 4*b* on the downstream side; therefore, the temperature of the rear region 4*b* undergoes only minor changes. Then, at time T2, the temperature of the front region 4*a* reaches the oxidation start temperature Tpm at which the deposited PM starts being oxidized and burned. The temperature of the rear region 4*b* also starts gradually rising from this time, and reaches the oxidation start temperature Tpm at time T3. Then, at time T4, the calculation-time temperature raising process is finished, and the temperature of each region starts falling.

Thus, once the temperature of each region of the filter 4 exceeds the oxidation start temperature Tpm, the PM deposited in this region is oxidized and burned, so that the deposition state of the PM in the filter 4 changes. As a result, a change in the PM deposition state is reflected by the exhaust differential pressure measured by the differential pressure sensor 8. For example, as shown in FIG. 2B, the exhaust differential pressure starts decreasing from time T2 at which the temperature of the front region 4*a* reaches the oxidation start temperature Tpm, and the exhaust differential pressure decreases as the deposited PM in each region is oxidized and burned while the calculation-time temperature raising process is performed.

More specifically, since only the temperature of the front region 4*a* exceeds the oxidation start temperature Tpm in a period of time T2 to time T3, only the PM deposited in this region is oxidized and burned, and the exhaust differential pressure is reduced by an amount of ΔdP_Fr. In a period of time T3 to time T4, the temperatures of the front region 4*a* and the rear region 4*b* exceed the oxidation start temperature Tpm. Therefore, in the period of time T3 to time T4, the PM deposited in both of the front and rear regions is oxidized and burned, and the exhaust differential pressure is reduced. Accordingly, where the reduction amount of the exhaust differential pressure due to oxidation and combustion of deposited PM in the front region 4*a* during the period of time T3 to time T4 is denoted as ΔdP_Fr2, and the reduction amount of the exhaust differential pressure due to oxidation and combustion of deposited PM in the rear region 4*b* is denoted as ΔdP_Rr, the reduction amount of the exhaust differential pressure in the same period is equal to the sum (ΔdP_Rr+ΔdP_Fr2) of both of the reduction amounts.

Here, the rate of oxidation of deposited PM in each region of the filter 4 when the calculation-time temperature raising process is performed will be focused on. Initially, the deposited PM in the front region 4*a* is oxidized and burned in the period of time T2 to time T3. Accordingly, the reduction amount ΔXpm (see FIG. 3A) of the deposited PM in the filter 4, which corresponds to the reduction amount ΔdP_Fr of the exhaust differential pressure in this period, represents the reduction amount of the deposited PM in the front region 4*a*. Since the reduction of the deposited PM occurs in the period of time T2 to time T3, the oxidation rate of the deposited PM in the front region 4*a* in this period may be represented by value Z0 that is obtained by dividing the reduction amount ΔXpm by the length of this period.

The oxidation rate of the deposited PM in the filter 4 is physically expressed by the following equation 1.

$$Z0=k[PM][O_2]^{\alpha}[NO_2]^{\beta} \quad \text{(Eq. 1)}$$

In this equation, Z0 is the oxidation rate, k is a constant of reaction rate, [PM] is PM deposition amount, $[O_2]^{\alpha}$ is the amount of oxygen, and $[NO_2]^{\beta}$ is the amount of nitrogen dioxide. The constant k of reaction rate is expressed by the following equation 2.

$$K=A\exp(-Ea/RT) \quad \text{(Eq. 2)}$$

In this equation, A is a frequency factor, Ea is activation energy, R is a gas constant, and T is oxidation temperature (absolute temperature).

As is understood from Eq. 1 above, the oxidation rate Z0 of the deposited PM in the front region 4*a* of the filter 4 can be expressed by the product of the PM deposition amount and parameters relating to various substances that oxidize the PM, and, has a proportional relationship with the PM deposition amount. Then, on the basis of the relationship between the PM deposition amount and the oxidation rate, the PM deposition amount Ypm in the front region 4*a* can be calculated from the oxidation rate Z0, as shown in FIG. 3B. While the oxidation rate Z0 is directly obtained by dividing the reduction amount ΔXpm by the length of the period of time T2 to time T3, the oxidation rate Z0 corresponds to a front-side proportion as the proportion of the magnitude of the reduction amount ΔdP_Fr of the exhaust differential pressure to the length of the period, in view of the correlation between the reduction amount ΔXpm and the reduction amount ΔdP_Fr of the exhaust differential pressure. The front-side proportion corresponds to the above-indicated first proportion. Accordingly, in view of the correlation as shown in FIG. 3B, the PM deposition amount in the front region 4*a* is calculated so as to be larger as the front-side proportion is larger.

The PM deposition amount in the rear region 4*b* can also be calculated in the same manner as in the case of the front region 4*a*, based on the reduction amount of the exhaust differential pressure in the period of time T3 to time T4, and the length of this period. However, in this period, the deposited PM in the front region 4*a* as well as the deposited PM in the rear region 4*b* is oxidized and burned, as described above, and the result is reflected by the reduction amount ΔdP_Rr+ΔdP_Fr2 of the differential pressure. Accordingly, in order to calculate the PM deposition amount in the rear region 4*b*, it may be necessary to use ΔdP_Rr as the reduction amount derived from the rear region 4*b*, out of the reduction amount ΔdP_Rr+ΔdP_Fr2 of the differential pressure. Then, as in the case of the front region 4*a*, the oxidation rate in the rear region 4*b* corresponds to a rear-side proportion as the proportion of the magnitude of the reduction amount ΔdP_Rr of the exhaust differential pressure to the length of the period of time T3 to time T4. The rear-side proportion corresponds to the above-indicated second proportion. Accordingly, if the correlation as shown in FIG. 3B is taken into consideration, the PM deposition amount in the rear region 4*b* is calculated so as to be larger as the rear-side proportion is larger.

As a method of extracting the reduction amount ΔdP_Rr from the reduction amount ΔdP_Rr+ΔdP_Fr2 of the exhaust differential pressure in the period of time T3 to time T4, the following methods will be illustrated by way of example. As a first extraction method, the period of time T3 to time T4 is set, so that the deposition amount of PM that is oxidized and burned in the front region 4*a* in the period of time T3 to time T4 becomes substantially equal to the deposition amount of PM that is oxidized and burned in the front region 4*a* in the period of time 12 to time T3. As one example of setting, the period of time T3 to time T4 is set to the same length as the period of time T2 to time T3. The reduction amount ΔdP_Fr2 as a part of the reduction amount ΔdP_Rr+ΔdP_Fr2 in the period of time T3 to time T4, which is measured under this condition, becomes equal to the reduction amount ΔdP_Fr in the period of time T2 to time T3. Thus, the reduction amount ΔdP_Rr can be calculated by subtracting the reduction amount ΔdP_Fr in the period of time T2 to time T3, from the reduction amount ΔdP_Rr+ΔdP_fr2 in the period of time T3 to time T4.

As a second extraction method, the reduction amount ΔdP_Rr is calculated, on the assumption that the oxidation/combustion speed of deposited PM in the front region 4*a* in the period of time T2 to time T3, during the calculation-time temperature raising process, is substantially equal to the oxidation/combustion speed of deposited PM in the front region 4*a* in the period of time T3 to time T4. More specifically, the reduction amount ΔdP_Fr2 derived from oxidation and combustion of deposited PM in the front region 4*a* during the period of time T3 to time T4 is calculated by multiplying the reduction amount ΔdP_Fr in the period of time T2 to time T3, by the ratio of the length of the period of time T3 to time T4 to the length of the period of time T2 to time T3. Then, the reduction amount ΔP_Rr is calculated by subtracting the calculated reduction amount ΔdP_Fr2, from the reduction amount ΔdP_Rr+ΔdP_Fr2 in the period of time T3 to time T4.

In the manner as described above, the exhaust emission control system of the internal combustion engine 1 shown in FIG. 1 is able to calculate the PM deposition amounts in the front region 4*a* and rear region 4*b* of the filter 4, by excusing the calculation-time temperature raising process and using the detection value of the differential pressure sensor 8. Also, in the calculation-time temperature raising process, it is possible to control the heater 3 so that the amount of heat supplied from the heater 3 to the filter 4 per unit time becomes equal in at least the period of time T2 to time T3 and the period of time T3 to time T4. In this manner, oxidation and combustion conditions of deposited PM in the front region 4*a* and the rear region 4*b* in each period can be made substantially equal, and accuracy in calculation of the PM deposition amount in each region may be enhanced.

Figure 4A:
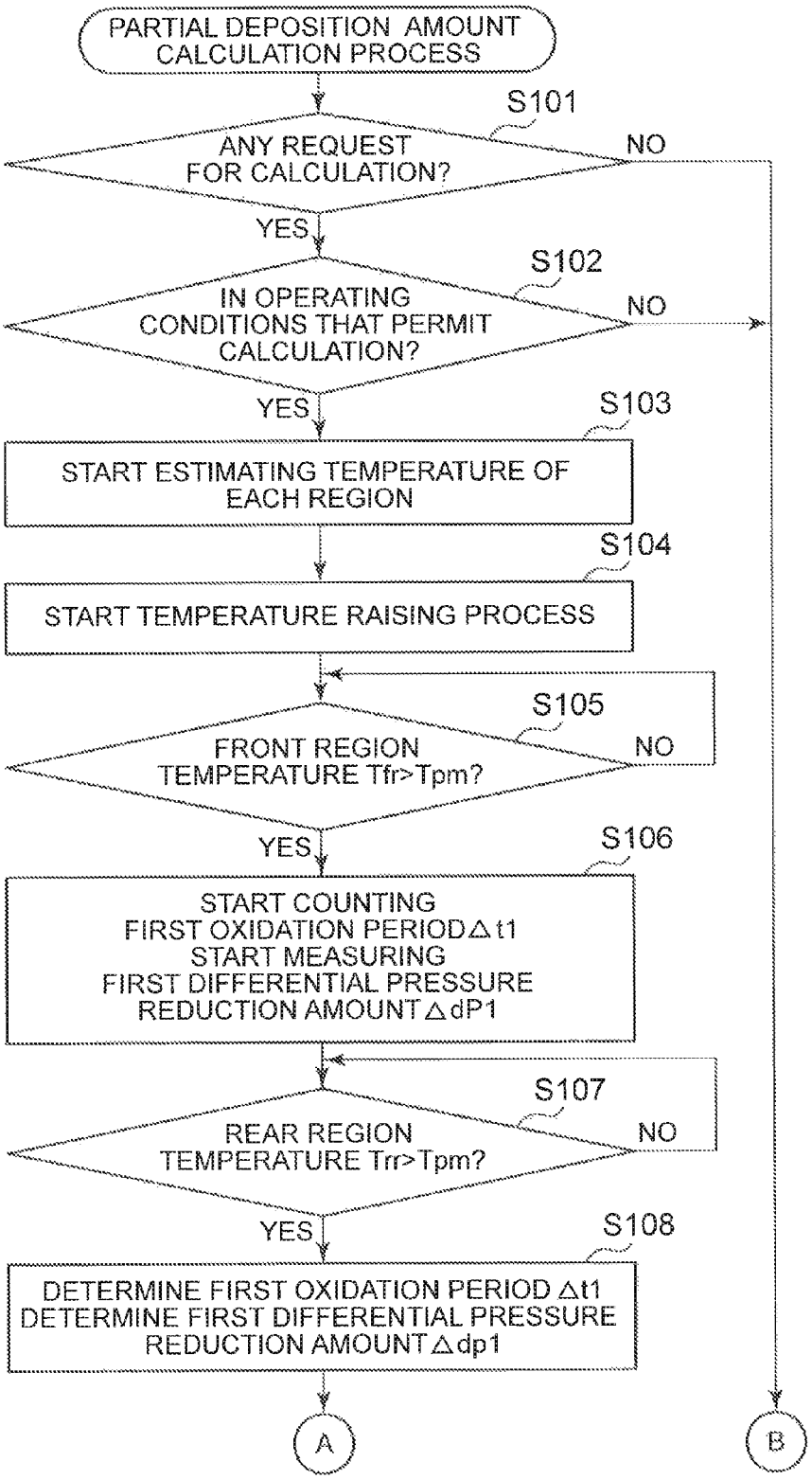
FIG. 4A shows a first flowchart concerning a process for calculating partial deposition amounts of the filter, which process is executed in the exhaust emission control system shown in FIG. 1A.
Figure 4B:
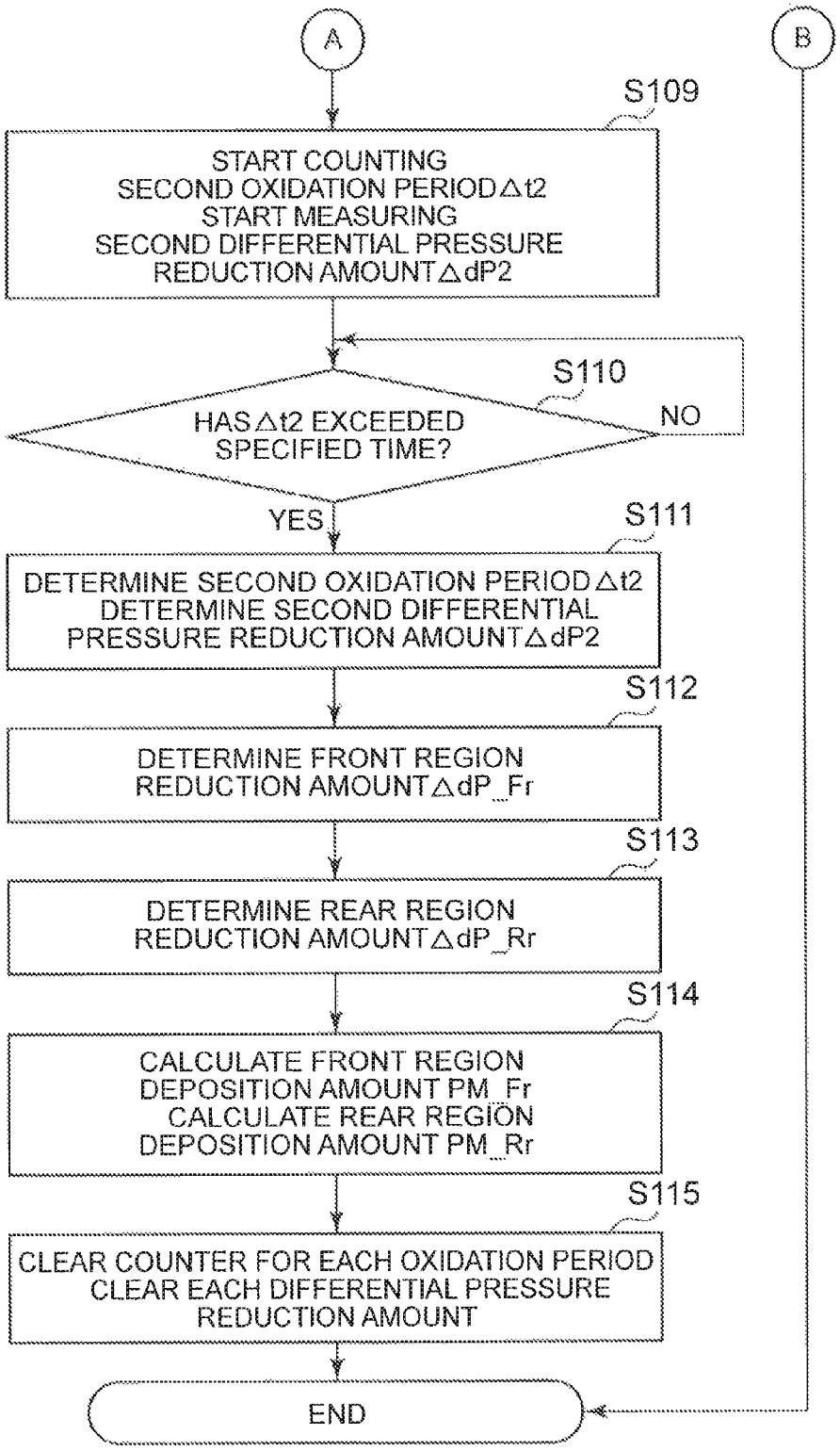
FIG. 4B shows a second flowchart concerning the process for calculating partial deposition amounts of the filter, which process is executed in the exhaust emission control system shown in FIG. 1A.

In the following, a partial deposition amount calculation process as processing for calculating partial deposition amounts in the front region 4*a* and the rear region 4*b* as described above will be described with reference to FIG. 4A and FIG. 4B. The partial deposition amount calculation process is divided into two sections as illustrated in FIG. 4A and FIG. 4B, respectively. The partial deposition amount calculation process is performed by executing a control program stored in a memory of the ECU 20. Initially, in step S101, it is determined whether there is a request for calculation of partial deposition amounts in the front region 4*a* and the rear region 4*b*. The calculation request is generated, for example, when the partial deposition amount in each region is needed, in certain control. For example, when the partial deposition amount calculation process is called for, in filter regeneration control illustrated in FIG. 5 and FIG. 6, or partial deposition amount estimation control illustrated in FIG. 7, which will be described later, the calculation request is generated. If an affirmative decision (YES) is obtained in step S101, the control proceeds to step S102. If a negative decision (NO) is obtained in step S101, the partial deposition amount calculation process is finished.

In step S102, it is determined whether the internal combustion engine 1 is in a condition where the partial deposition amounts can be calculated. To calculate the partial deposition amounts in the manner as described above, the calculation-time temperature raising process may be performed. While a part of the deposited PM in the front region 4*a* and the rear region 4*b* is oxidized and burned during the temperature raising process, it is possible that oxidation and combustion conditions do not vary largely during the period in which the calculation-time temperature raising process is performed, so as to possibly avoid reduction of the calculation accuracy. Thus, it may be determined that the engine 1 is in the condition where the partial deposition amounts can be calculated, for example, during idling operation in which the flow rate and temperature of exhaust gas from the engine 1 are stable. If an affirmative decision (YES) is obtained in step S102, the control proceeds to step S103. If a negative decision (NO) is obtained in step S102, the partial deposition amount calculation process is finished.

Then, in step S103, the temperatures of the front region 4*a* and the rear region 4*b* start being estimated. More specifically, the ECU 20 starts temperature estimation, based on conditions of heating by the heater 3 (e.g., the amount of heat supplied from the heater 3 to the filter 4 per unit time), and various parameters (such as the heat capacity of the filter 4, the flow rate of exhaust gas flowing through the filter 4, and the heat radiation coefficient in the filter 4) related to thermal propagation in the filter 4. At this time, the distance between the position of a point in the front region 4*a* representing the temperature of the front region 4*a* and the position of a point in the rear region 4*b* representing the temperature of the rear region 4*b* is also taken into consideration.

Then, in step S104, the calculation-time temperature raising process is started, and drive current is supplied to the heater 3. As a result, thermal energy is supplied from the heater 3 to the filter 4, under a condition that the amount of heat supplied per unit time is constant. The amount of heat supplied per unit time in the calculation-time temperature raising process is determined so that the temperature of the filter 4 can reach the oxidation start temperature Tpm at which the deposited PM can be burned. A point in time at which the calculation-time temperature raising process is started is denoted as time T1 in FIG. 2A. Then, in step S105, it is determined whether the estimated temperature Tfr of the front region 4*a* exceeds the oxidation start temperature Tpm. If an affirmative decision (YES) is obtained in step S105, the control proceeds to step S106. If a negative decision (NO) is obtained in step S105, step S105 is repeated again. A point in time at which an affirmative decision (YES) is obtained in step S105 is denoted as time T2 in FIG. 2A.

Once the temperature of the front region 4*a* exceeds the oxidation start temperature Tpm, step S106 is executed to start counting a first oxidation period Δt1 in which only the deposited PM in the front region 4*a* located on the upstream side is oxidized and burned. Accordingly, the starting point of the first oxidation period Δt1 is time T2 in FIG. 2A. Then, a first differential pressure reduction amount ΔdP1 as an amount of reduction of the exhaust differential pressure caused by oxidation and combustion of only the deposited PM in the front region 4*a* starts being measured, while at the same time the first oxidation period Δt1 is counted. The first differential pressure reduction amount ΔdP1 is measured, regarding the exhaust differential pressure at time T2 that is the starting point of the first oxidation period Δt1, as a starting point. After execution of step S106, the control proceeds to step S107.

In step S107, it is determined whether the estimated temperature Trr of the rear region 4*b* exceeds the oxidation start temperature Tpm. If an affirmative decision (YES) is obtained in step S107, the control proceeds to step S108. If a negative decision (NO) is obtained, step S107 is repeated again. A point in time at which an affirmative decision (YES) is obtained in step S107 is denoted as time T3 in FIG. 2A. Then, in step S108, the first oxidation period Δt1 is determined, based on the determination in step S107 that the temperature of the rear region 4*b* exceeds the oxidation start temperature Tpm. Namely, the first oxidation period Δt1 is determined as a period from time T2 as the above-indicated starting point to time T3 as an ending point. At the same time, a first differential pressure reduction amount ΔdP1 is determined, regarding the exhaust differential pressure at time T2 as a starting point and regarding the exhaust differential pressure at time T3 as an ending point. After execution of step S108, the control proceeds to step S109.

Once the temperature of the rear region 4*b* exceeds the oxidation start temperature Tpm, step S109 is executed to start counting a second oxidation period Δt2 that starts when the deposited PM in the rear region 4*b* located on the downstream side starts being oxidized and burned. Accordingly, the starting point of the second oxidation period Δt2 is time T3 in FIG. 2A. Then, a second differential pressure reduction amount ΔdP2 as an amount of reduction of the exhaust differential pressure caused by oxidation and combustion of the deposited PM in the rear region 4*b* and the deposited PM in the front region 4*a* starts being measured, while at the same time the second oxidation period Δt2 is counted. The second differential pressure reduction amount ΔdP2 is measured, regarding the exhaust differential pressure at time T3 that is the starting point of the second oxidation period Δt2, as a starting point. After execution of step S109, the control proceeds to step S110.

In step S110, it is determined whether the second oxidation period Δt2 has exceeded a specified time. The specified time may be set to a desired length of time, as long as a significant differential pressure reduction amount is measured as the second differential pressure reduction amount ΔdP2 caused by oxidation and combustion of the deposited PM in the rear region 4*b* and the deposited PM in the front region 4*a*. In this embodiment, the specified time is set to the same length of time as the first oxidation period Δt1. If an affirmative decision (YES) is obtained in step S110, the control proceeds to step S111. If a negative decision (NO) is obtained, step S110 is repeated again. A point in time at which an affirmative decision (YES) is obtained in step S110 is denoted as time T4 in FIG. 2A. Then, in step S111, the second oxidation period Δt2 is determined, based on the determination that the second oxidation period Δt2 has exceeded the specified time. Namely, the second oxidation period Δt2 is determined as a period from time T3 as the above-indicated starting point to time T4 as an ending point, in other words, as a period having the same length of time as the first oxidation period Δt1. At the same time, a second differential pressure reduction amount ΔdP2 is determined, regarding the exhaust differential pressure at time T3 as a starting point, and regarding the exhaust differential pressure at time T4 as an ending point. After execution of step S111, the control proceeds to step S112.

In step S112, the above-indicated ΔdP_Fr as the front region reduction amount used for calculating the PM deposition amount in the front region 4*a* is determined based on the first differential pressure reduction amount ΔdP1. More specifically, since only the deposited PM in the front region 4*a* is oxidized and burned in the first oxidation period Δt1, the front region reduction amount ΔdP_Fr is the first differential pressure reduction amount ΔdP1 itself. Then, in step S113, the above-indicated ΔdP_Rr as the rear region reduction amount used for calculating the PM deposition amount in the rear region 4*b* is determined based on the second differential pressure reduction amount ΔdP2. More specifically, the second oxidation period Δt2 is set to the same length as the first oxidation period Δt1, according to the first extraction method as described above, so that the amount of the deposited PM oxidized in the front region 4*a* during the second oxidation period Δt2 can be regarded as the same amount as the amount of the deposited PM oxidized in the front region 4*a* during the first oxidation period Δt1. Thus, the rear region reduction amount ΔdP_Rr is obtained by subtracting the first differential pressure reduction amount ΔdP1 from the second differential pressure reduction amount ΔdP2.

Then, in step S114, the PM deposition amount PM_Fr in the front region 4*a* is calculated as explained above with reference to FIG. 3B, based on the proportion of the magnitude of the front region reduction amount ΔdP_Fr to the length of the first oxidation period Δt1, which corresponds to the above-mentioned front-side proportion. More specifically, the PM deposition amount PM_Fr in the front region 4*a* is calculated so as to be larger as this proportion is larger. Also, the PM deposition amount PM_Rr in the rear region 4*b* is calculated as explained above with reference to FIG. 3B, based on the proportion of the rear region reduction amount ΔdP_Rr to the length of the second oxidation period Δt2, which corresponds to the above-mentioned rear-side proportion. More specifically, the PM deposition amount PM_Rr in the rear region 4*b* is calculated so as to be larger as this proportion is larger.

Subsequently, in step S115, counters of the first oxidation period Δt1 and the second oxidation period Δt2 are cleared, and measurement values of the first differential pressure reduction amount ΔdP1 and the second differential pressure reduction amount ΔdP2 are cleared, for the next calculation of partial deposition amounts.

In the partial deposition amount calculation process as described above, the second oxidation period Δt2 is set to the same length as the first oxidation period Δt1, so as to extract the rear region reduction amount ΔdP_Rr by the first extraction method. However, in place of this arrangement, the second oxidation period Δt2 may be set to a different length of time from the first oxidation period Δt1. Even if the first and second oxidation periods are set to different lengths of time, the rear region reduction amount ΔdP_Rr may be extracted by the first extraction method, in the case where the amount of the deposited PM oxidized in the front region 4*a* during the second oxidation period Δt2 can be regarded as the same amount as the amount of the deposited PM oxidized in the front region 4*a* during the first oxidation period Δt1. If these amounts are not the same amount, the rear region reduction amount ΔdP_Rr may be extracted by the second extraction method as described above.

In the partial deposition amount calculation process as described above, the first oxidation period Δt1 is defined as a period (period of time T2 to time T3) from the time when the temperature Tfr of the front region 4*a* exceeds the oxidation start temperature Tpm to the time when the temperature Trr of the rear region 4*b* exceeds the oxidation start temperature Tpm. However, in place of this arrangement, the first oxidation period Δt1 may be a part of the period of time T2 to time T3, as long as a significant value can be obtained as the first differential pressure reduction amount ΔdP1. In this case, the first differential pressure reduction amount ΔdP1 is a differential pressure reduction amount corresponding to the part of the period. Also, the second oxidation period Δt2 may be any period after the temperature Trr of the rear region 4*b* exceeds the oxidation start temperature Tpm, as long as a significant value can be obtained as the second differential pressure reduction amount ΔdP2. In this case, the second differential pressure reduction amount ΔdP2 is a differential pressure reduction amount corresponding to the above-indicated any period.

In the following, a first example of filter regeneration control for performing a filter regeneration process on the filter 4, using the above-described partial deposition amount calculation process, will be described with reference to FIG. 5. The filter regeneration control is performed by executing a control program stored in the memory of the ECU 20. As a precondition for the filter regeneration control, the PM deposition amount in the filter 4 as a whole may be estimated as needed, based on operating conditions, such as the engine rotational speed and engine load, of the internal combustion engine 1. Although the process of estimating the PM deposition amount in the filter 4 as a whole is different from the above-described partial deposition amount calculation process, the estimating process may be conducted according to the prior art, and therefore, will not be described in detail. The PM deposition amount in the filter 4 as a whole will be called "overall PM deposition amount X1".

Figure 5:
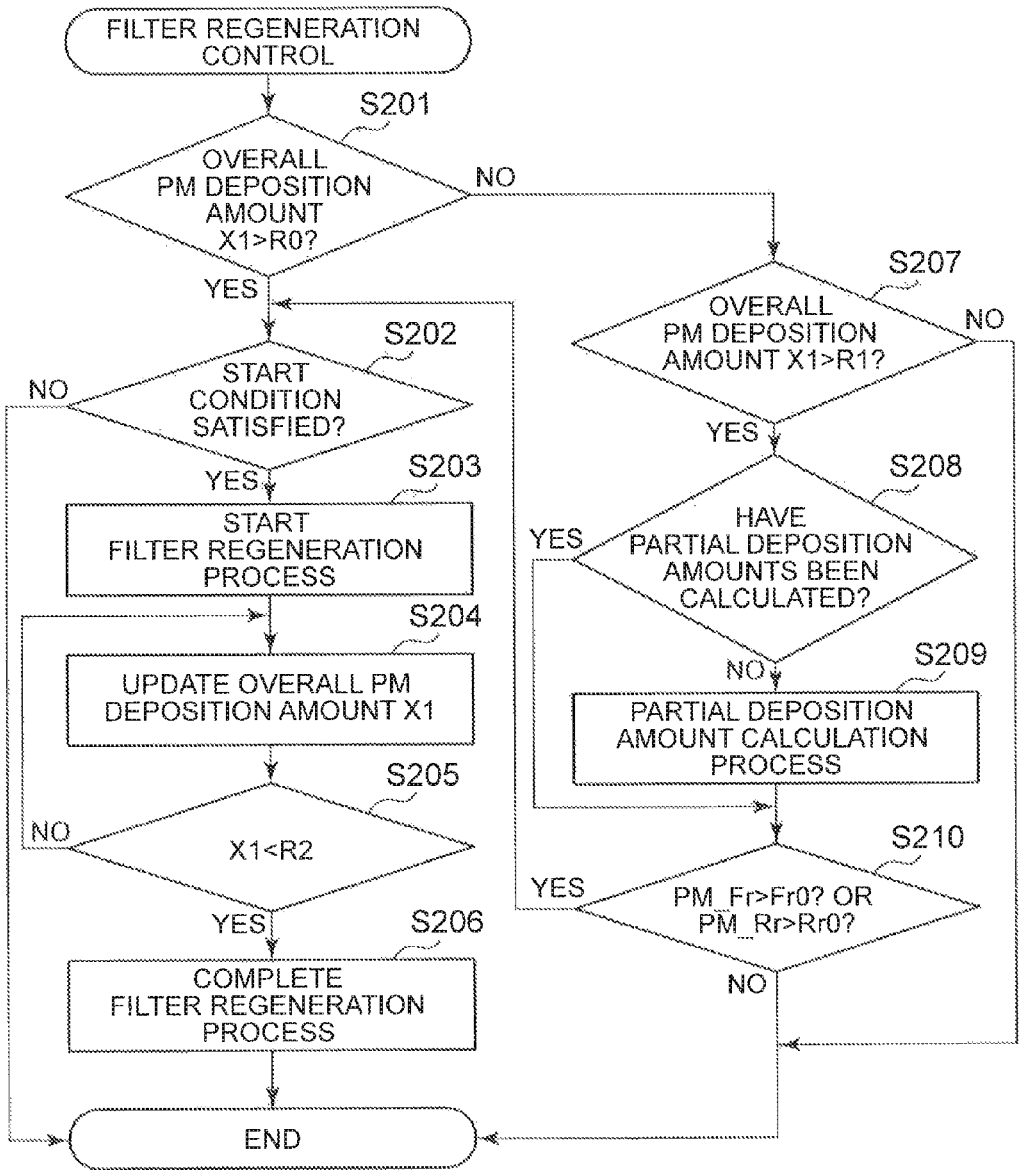
FIG. 5 is a flowchart of first filter regeneration control for performing a filter regeneration process, utilizing the partial deposition amount calculation process shown in FIG. 4A and FIG. 4B.

The process of steps S201-S206 in the filter regeneration control illustrated in FIG. 5 is a standard series of steps for carrying out a filter regeneration process. Initially, in step S201, it is determined whether the overall PM deposition amount X1 of the filter 4 exceeds a regeneration reference amount R0. The regeneration reference amount R0 is a threshold value based on which it is determined that the PM is deposited to such an extent that the filter regeneration process should be performed on the filter 4. If the PM deposition amount in the filter 4 as a whole exceeds the regeneration reference amount R0, the exhaust pressure in the exhaust passage 2 increases, and an undesirable influence is exerted on operation of the engine 1. If an affirmative decision (YES) is obtained in step S201, the control proceeds to step S202. If a negative decision (NO) is obtained in step S201, the control proceeds to step S207.

Then, it is determined in step S202 whether a starting condition or conditions for starting the filter regeneration process is/are satisfied. More specifically, one example of the starting condition(s) is that the temperature of exhaust gas flowing into the filter 4 is equal to or higher than a given temperature that is high enough to permit deposited PM to be efficiently oxidized and removed. As the temperature of exhaust gas flowing into the filter 4, the detection value of the temperature sensor 7 may be used. If an affirmative decision (YES) is obtained in step S202, the control proceeds to step S203. If a negative decision (NO) is obtained in step S202, this control ends.

In step S203, the filter regeneration process is carried out. More specifically, fuel is supplied from the fuel supply valve 5 to exhaust gas as described above, so that the temperature of the filter 4 is raised to a level that exceeds the oxidation start temperature Tpm, through oxidation reactions using the oxidation catalyst supported on the filter 4, and the filter 4 is kept at the temperature level. To keep the temperature of the filter 4 at this level, the temperature detected by the temperature sensor 9 is used. With the filter regeneration process thus performed, the PM deposited in the filter 4 is oxidized and removed. Thus, the overall PM deposition amount X1 is updated in step S204, so as to reflect reduction of the PM deposition amount through the oxidation and removal of the deposited PM. The overall PM deposition amount X1 is updated, in view of the amount of PM oxidized and removed per unit time through the filter regeneration process, and an elapsed time from the time when the temperature of the filter 4 reaches the oxidation start temperature Tpm through the filter regeneration process, for example.

In step S205, it is determined whether the overall PM deposition amount X1 updated in step S204 is smaller than a reference PM deposition amount R2. The reference PM deposition amount R2 is a threshold value used for determining whether the filter regeneration process is to be finished. If an affirmative decision (YES) is obtained in step S205, the control proceeds to step S206. If a negative decision (NO) is obtained in step S205, step S204 is repeatedly executed. Step S204 is repeatedly executed while the filter regeneration process started in step S203 is being continuously performed. In step S206, the filter regeneration process is completed. When the filter regeneration process is completed, an execution flag indicating that the partial deposition amount calculation process that will be described later has been executed is set to OFF.

While the deposited PM of the filter 4 is oxidized and removed through the process of steps S201 to S206, a series of steps S207 to S210 including the above-described partial deposition calculation process is executed when a negative decision (NO) is obtained in step S201. In step S207, it is determined whether the overall PM deposition amount X1 exceeds a partial calculation reference amount R1. The partial calculation reference amount R1 is smaller than the regeneration reference amount R0 but larger than the reference PM deposition amount R2, and is a threshold value used for determining whether the partial deposition calculation process executed in step S209 which will be described later is to be executed. If an affirmative decision (YES) is obtained in step S207, the control proceeds to step S208. If a negative decision (NO) is obtained in step S207, this control ends.

In step S208, it is determined, based on the above-mentioned execution flag, whether the partial deposition calculation process executed in step S209 which will be described later has been executed, and the front region deposition amount PM_Fr and the rear region deposition amount PM_Rr have already been calculated. In this control, the partial deposition amount calculation process is performed once in a period between one filter regeneration process and the next filter regeneration process. Accordingly, the determination in step S208 as to whether the partial deposition amount calculation process has already been executed is made with respect to the above-indicated period. If an affirmative decision (YES) is obtained in step S208, the control proceeds to step S210. If a negative decision (NO) is obtained in step S208, the control proceeds to step S209.

In step S209, the partial deposition amount calculation process is executed, and the execution flag is set to ON. Through the partial deposition amount calculation process, the front region deposition amount PM_Fr and the rear region deposition amount PM_Rr are calculated. Then, it is determined in step S210 whether the front region deposition amount PM_Fr exceeds a first reference deposition amount Fr0, or the rear region deposition amount PM_Rr exceeds a second reference deposition amount Rr0. If at least one of the front region deposition amount PM_Fr and the rear region deposition amount PM_Rr exceeds the corresponding reference amount, an affirmative decision (YES) is obtained in step S210. In this case, step S202 and subsequent steps are executed. On the other hand, if both of the front region deposition amount PM_Fr and the rear region deposition amount PM_Rr do not exceed the reference amounts, a negative decision (NO) is obtained in step S210. In this case, this control ends. Here, the first reference deposition amount Fr0 is a threshold value used for determining that, if the filter regeneration process is not performed even in a condition where the PM deposition amount in the front region 4*a* exceeds the first reference deposition amount Fr0, and the filter regeneration process is subsequently performed based on the PM deposition amount of the filter 4 as a whole, there is a possibility that an excessive rise in the temperature of a local region of the filter arises due to a large amount of PM locally deposited in the front region 4*a*. Also, the first reference deposition amount Fr0 is set to the PM deposition amount that does not cause the temperature of the front region 4*a* as a local region of the filter 4 to be excessively increased, even if the filter regeneration process is performed when the PM deposition amount in the front region 4*a* is equal to the first reference deposition amount Fr0. The second reference deposition amount Rr0 is a threshold value used for determining that, if the filter regeneration process is not performed even in a condition where the PM deposition amount in the rear region 4*b* exceeds the second reference deposition amount Rr0, and the filter regeneration process is subsequently performed based on the PM deposition amount of the filter 4 as a whole, there is a possibility that an excessive rise in the temperature of a local region of the filter arises due to a large amount of PM locally deposited in the rear region 4*b*. Also, the second reference deposition amount Rr0 is set to the PM deposition amount that does not cause the temperature of the rear region 4*b* as a local region of the filter 4 to be excessively increased, even if the filter regeneration process is performed when the PM deposition amount in the rear region 4*b* is equal to the second reference deposition amount Rr0.

In the filter regeneration control as described above, even in a condition where the PM deposition amount of the filter 4 as a whole does not exceed the regeneration reference amount R0, the filter regeneration process is executed if the partial deposition amount in at least one of the front region 4*a* and the rear region 4*b* exceeds the reference deposition amount, thus giving rise to a possibility of an excessive rise in the temperature of a local region. Thus, the filter regeneration process may be executed early, so that the deposited PM in the filter 4 as a whole is oxidized and removed before the excessive rise in the temperature of the local region becomes apparent, whereby erosion of the filter 4, deterioration of the oxidation catalyst, etc., that would be caused by the filter regeneration process can be avoided.

When the partial deposition amount calculation process is performed, the calculation-time temperature raising process for calculating the partial deposition amount of each region is performed, and a part of the PM deposited in each region is oxidized and burned; therefore, the PM deposition amount in the filter 4 as a whole may be reduced. Thus, in this case, the amount of PM oxidized and burned may be reflected by the value of the overall PM deposition amount X1 which is estimated as needed. If the amount of PM oxidized through the calculation-time temperature raising process is so small that it can be ignored, it may not be reflected by the value of the overall PM deposition amount X1.

A second example of filter regeneration control under which the filter regeneration process of the filter 4 is performed using the partial deposition amount calculation process as described above will be described with reference to FIG. 6. The filter regeneration control is performed by executing a control program stored in the memory of the ECU 20. As a precondition for the filter regeneration control, the overall PM deposition amount X1 in the filter 4 as a whole may be estimated as needed, in the same manner as in the above-described first example. Further, an execution flag based on which it is determined whether the partial deposition amount calculation process has been executed, in a period between one filter regeneration process and the next filter regeneration process, is used.

Initially, it is determined in step S301 whether the overall PM deposition amount X1 of the filter 4 exceeds the regeneration reference amount R0. This determination is substantially the same as the determination in step S201 as described above. If an affirmative decision (YES) is obtained in step S301, the control proceeds to step S302. If a negative decision (NO) is obtained in step S301, this control ends. Then, in step S302, it is determined, based on the above-mentioned execution flag, whether the partial deposition amount calculation process executed in step S303 as will be described later has been executed, and the front region deposition amount PM_Fr and the rear region deposition amount PM_Rr have already been calculated. The determination in step S302 is substantially the same as the determination in step S208 as described above. If an affirmative decision (YES) is obtained in step S302, the control proceeds to step S304. If a negative decision (NO) is obtained in step S302, the control proceeds to step S303. Then, in step S303, the partial deposition amount calculation process is executed, and the execution flag is set to ON. Through the partial deposition amount calculation process, the front region deposition amount PM_Fr and the rear region deposition amount PM_Rr are calculated.

Then, it is determined in step S304 whether the front region deposition amount PM_Fr is equal to or smaller than a third reference deposition amount Fr1, and the rear region deposition amount PM_Rr is equal to or smaller than a fourth reference deposition amount Rr1. Here, the third reference deposition amount Fr1 is different from the first reference deposition amount Fr0 used in the above step S210, and is a threshold value based on which it is determined that there is a possibility of an excessive rise in the temperature of a local region of the filter due to a large amount of PM locally deposited in the front region 4*a* if the filter regeneration process is performed at this time. Similarly, the fourth reference deposition amount Rr1 is also different from the second reference deposition amount Rr0 used in the above step S210, and is a threshold value based on which it is determined that there is a possibility of an excessive rise in the temperature of a local region of the filter due to a large amount of PM locally deposited in the rear region 4*b* if the filter regeneration process is performed at this time. Namely, the third reference deposition amount Fr1 and the fourth reference deposition amount Rr1 may be set so that there is a reduced possibility of an excessive rise in the temperature of a local region of the filter even if the filter regeneration process is performed when the PM deposition amount of each region is equal to or smaller than the corresponding reference deposition amount, but there is a possibility of an excessive rise in the temperature of a local region of the filter if the filter regeneration process is performed when the PM deposition amount of each region exceeds the corresponding reference deposition amount. If an affirmative decision (YES) is obtained in step S304, the control proceeds to step S305. If a negative decision (NO) is obtained in step S304, the control proceeds to step S306.

In step S305, an execution condition of a standard filter regeneration process performed as the regeneration process of the filter 4 when an affirmative decision (YES) is obtained in step S304 is set. The affirmative decision obtained in step S304 means that there is a reduced possibility of an excessive rise in the temperature of a local region in the filter 4, even if the filter regeneration process is executed at this time. Thus, the execution condition of the standard filter regeneration process is a fuel supply condition to be satisfied by the fuel supply valve 5, under which the fuel supplied from the fuel supply valve 5 is oxidized and burned in the filter 4 on which PM whose amount exceeds the overall PM deposition amount X1 is deposited, so that the temperature of the filter 4 promptly reaches a temperature level exceeding the oxidation start temperature Tpm, and the fuel thus supplied is not deposited in the filter 4 without being oxidized. The fuel supply condition may be varied depending on the temperature of the filter 4, the exhaust flow rate, etc. If the execution condition is set in step S305, step S307 and subsequent steps are executed to perform the filter regeneration process according to the execution condition, namely, the standard filter regeneration process.

On the other hand, in step S306, an execution condition of a slow filter regeneration process performed as the regeneration process of the filter 4 when a negative decision (NO) is obtained in step S304 is determined. The negative decision thus obtained in step S304 means that there is a possibility of an excessive rise in the temperature of a local region in the filter 4 if the filter regeneration process is performed at this time. Thus, the execution condition of the slow filter regeneration process is a fuel supply condition to be satisfied by the fuel supply valve 5, under which, when fuel is supplied from the fuel supply valve 5 to the filter 4 on which PM whose amount exceeds the overall PM deposition amount X1 is deposited, the temperature of the filter 4 is slowly increased so as to suppress an excessive rise in the temperature of a local region in the filter 4. Therefore, when the front region deposition amount PM_Fr exceeds the third reference deposition amount Fr1, the amount of fuel supplied from the fuel supply valve 5 per unit time is reduced as the excess amount increases, in other words, the amount of heat supplied to the filter 4 per unit time for the filter regeneration process is reduced. Similarly, when the rear region deposition amount PM_Rr exceeds the fourth reference deposition amount Rr1, the amount of fuel supplied from the fuel supply valve 5 per unit time is reduced as the excess amount increases. If the execution condition is set in step S306, step S307 and subsequent steps are executed to perform the filter regeneration process according to the execution condition, namely, the slow filter regeneration process is performed.

After execution of step S305 or step S306, step S307 and subsequent steps are executed. The process of steps S307-S311 is substantially the same as that of steps S202-S206 as described above, and therefore, will not be described in detail.

In the filter regeneration control as described above, if the PM deposition amount of the filter 4 as a whole exceeds the regeneration reference amount R0, the partial deposition amount of the front region 4*a* and that of the rear region 4*b* are calculated, before the regeneration process of the filter 4 is performed. Then, when there is no possibility of an excessive rise in the temperature of a local region in the filter 4, the standard filter regeneration process is subsequently performed. Namely, the standard filter regeneration process is performed, following the calculation-time temperature raising process, without reducing the filter temperature that has been raised by the calculation-time temperature process. At this time, since the temperature of the filter 4 has been raised to some extent by the calculation-time temperature raising process, the amount of energy for raising the temperature of the filter 4 by the standard filter regeneration process can be reduced. If there is a possibility of an excessive rise in the temperature of a local region in the filter 4, the temperature of the filter 4 is slowly increased by the slow filter regeneration process, so that the otherwise possible excessive rise in the temperature of the local region in the filter 4 can be avoided, though the time required to oxidize and remove the deposited PM is prolonged.

Figure 6:
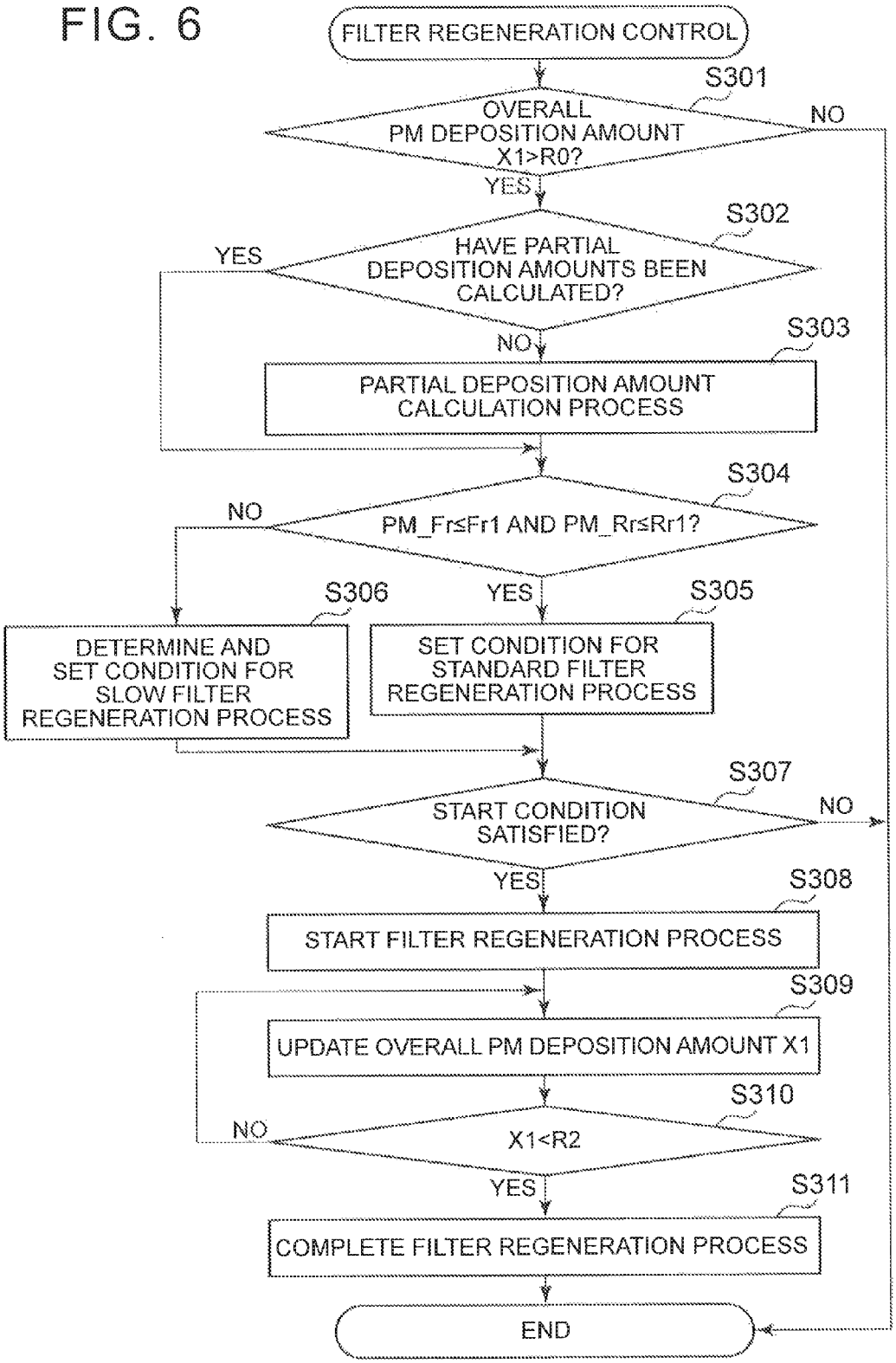
FIG. 6 is a flowchart of second filter regeneration control for performing a filter regeneration process, utilizing the partial deposition amount calculation process shown in FIG. 4A and FIG. 4B.
Figure 7:
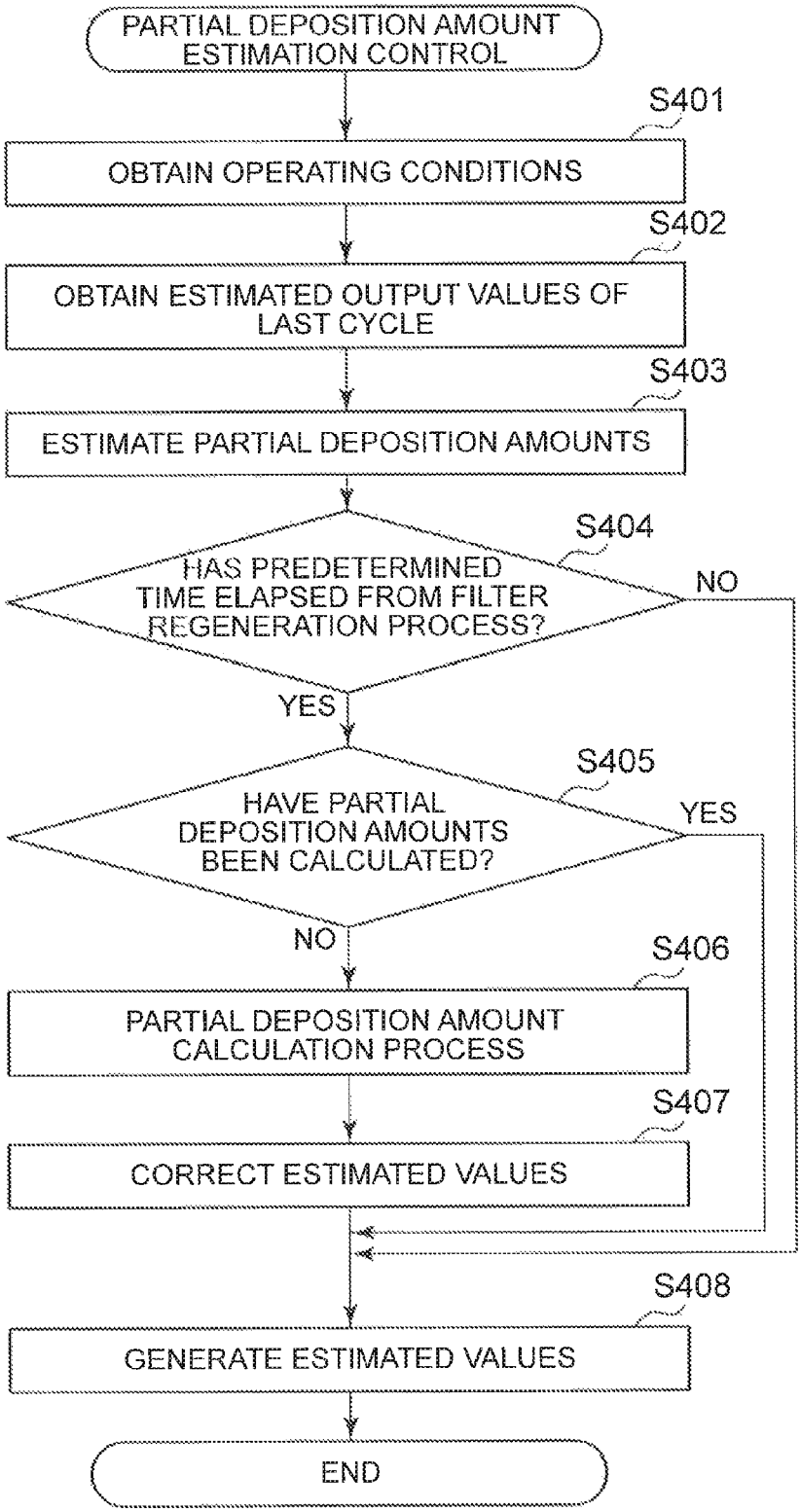
FIG. 7 is a flowchart of partial deposition amount estimation control for performing a process of estimating partial deposition amounts in the filter, utilizing the partial deposition amount calculation process shown in FIG. 4A and FIG. 4B.

In the following, partial deposition amount estimation control of the filter 4 using the above-described partial deposition amount calculation process will be described with reference to FIG. 7. The partial deposition amount estimation control is control for estimating the partial deposition amounts of the front region 4*a* and the rear region 4*b*, and is performed by executing a control program stored in the memory of the ECU 20. Also, in parallel with this control, control concerning the filter regeneration process for the filter 4, for example, control illustrated in FIG. 5 or FIG. 6, is repeatedly executed. In this control, the partial deposition amount calculation process in step S406 that will be described later may be performed only once, in a period between one filter regeneration process and the next filter regeneration process. When the filter regeneration process ends, the execution flag indicating that the partial deposition amount calculation process has been executed by this point in time is set to OFF.

Initially, in step S401, operating conditions of the internal combustion engine 1 are obtained. Then, in step S402, estimated output values of respective regions obtained when this control was executed last time, namely, estimated output values of the respective partial deposition amounts of the front region 4*a* and the rear region 4*b*, which were generated in step S408 as will be described later, are obtained. The estimated output values obtained in the last cycle of the control are stored in the memory of the ECU 20.

Then, in step S403, the respective partial deposition amounts of the front region 4*a* and the rear region 4*b* at this time are estimated, based on the operating conditions of the engine 1 obtained in step S401, and the last estimated output values obtained in step S402. More specifically, relationships between the operating conditions of the engine 1 and the amount of PM additionally deposited in each region of the filter 4, which were obtained in advance by experiment, or the like, are stored in the form of a control map in the memory of the ECU 20. Then, the PM deposition amount, or the amount of PM additionally deposited in each region, is calculated with reference to the control map, based on the operating conditions at this time, namely, the operating conditions obtained in step S401. Then, the estimated output value of each region in this cycle is calculated by adding the PM deposition amount thus calculated to the estimated output value of each region generated in the last cycle. After execution of step S403, the control proceeds to step S404.

In step S404, it is determined whether a predetermined time has elapsed from the time when the filter regeneration process of the filter 4 executed in parallel with this control is completed. The time at which the filter regeneration process is completed is the time when step S206 of the filter regeneration control shown in FIG. 5 is executed, or when step S311 of the filter regeneration control shown in FIG. 6 is executed. The predetermined time is a length of time it takes from the time when the filter regeneration process is completed, to the time when the PM is deposited again in the filter 4 until the PM deposition amount reaches an amount large enough to permit the partial deposition amount calculation process to be performed. Namely, the predetermined time is determined, in view of the need to oxidize and burn a part of the deposited PM in each region by the calculation-time temperature raising process, in the partial deposition amount calculation process. If an affirmative decision (YES) is obtained in step S404, the control proceeds to step S405. If a negative decision (NO) is obtained, the control proceeds to step S408.

In step S405, it is determined based on the execution flag whether the partial deposition calculation process executed in step S406 that will be described later has been executed, and the front region deposition amount PM_Fr and the rear region deposition amount PM_Rr have already been calculated. The determination in step S405 is substantially the same as the determination in step S208, etc. as described above, and therefore, will not be described in detail. If an affirmative decision (YES) is obtained in step S405, the control proceeds to step S407. If a negative decision (NO) is obtained in step S405, the control proceeds to step S406. Then, in step S406, the partial deposition amount calculation process is performed, so that the front region deposition amount PM_Fr and the rear region deposition amount PM_Rr are calculated, and the execution flag is set to ON.

Then, in step S407, the partial deposition amounts of the front region 4*a* and the rear region 4*b* estimated in step S403 are corrected based on the calculated front region deposition amount PM_Fr and rear region deposition amount PM_Rr. In one example of correction, when there is a difference between the estimated partial deposition amount and the calculated deposition amount of each region, a given correction value is added to the estimated partial deposition amount, so that the estimated partial deposition amount becomes closer to the calculated deposition amount of each region. After execution of step S407, the control proceeds to step S408.

In step S408, the estimated value of the partial deposition amount of each region obtained through this cycle of the partial deposition amount estimation control is generated. If the control reaches step S408 via step S407, the estimated value of each region subjected to the correction in step S407 is generated as the estimated value of this cycle. If the control reaches step S408 after a negative decision (NO) is obtained in step S404, the estimated value of each region estimated in step S403 is generated as the estimated value of each region of this cycle. Then, the estimated value of each region generated in this step S408 provides an estimated output value of each region which is to be obtained in step S402 in the next cycle of the partial deposition amount estimation control.

In the partial deposition amount estimation control as described above, the partial deposition amount in each region can be estimated based on the operating conditions of the engine 1. In the meantime, the estimated value may deviate largely from the actual partial deposition amount. Thus, the partial deposition amount calculation process as described above is performed, and the estimated partial estimation amount is corrected based on the result of the calculation. The corrected partial deposition amount, which reflects the calculation result, is reflected by the partial deposition amount estimated in the next cycle of the partial deposition amount estimation control; therefore, once correction is conducted, the correction continues to be reflected by the estimated values in subsequent cycles. Thus, according to the partial deposition amount estimation control, the partial deposition amount of each region can be accurately estimated.

The estimated partial deposition amount of each region may be used in controls for various purposes performed in the exhaust emission control system of the internal combustion engine 1. The above-indicated given correction value used in correction of step S407 is cleared when the filter regeneration process is performed in the filter 4.

Figure 8A:
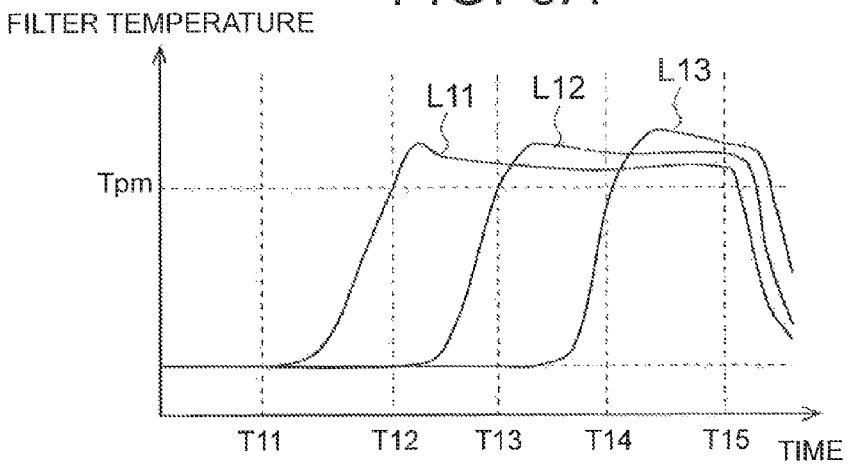
FIG. 8A shows changes in the filter temperature with time due to a temperature raising process performed when calculating partial PM deposition amounts of the filter, when the filter is divided into three regions.
Figure 8B:
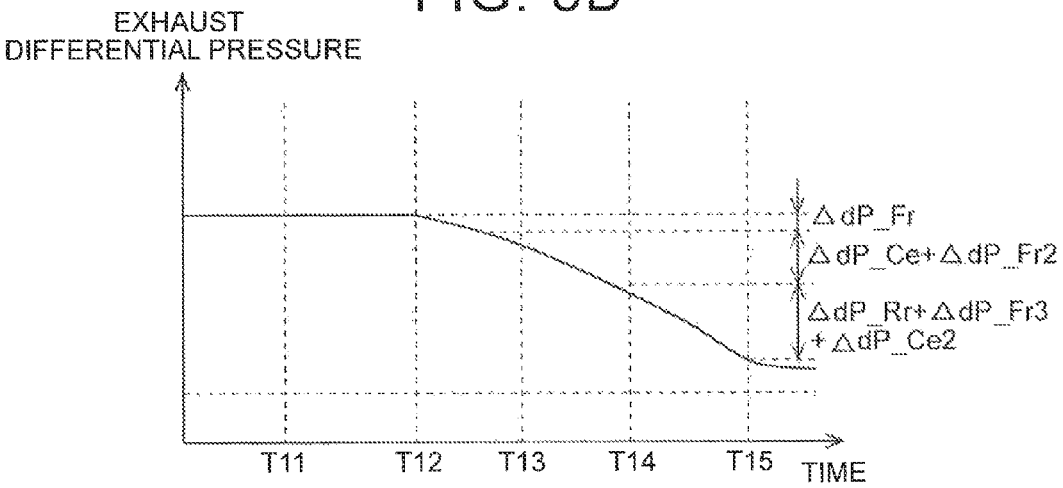
FIG. 8B shows changes in the exhaust differential pressure as a difference between exhaust pressures upstream and downstream of the filter, due to the temperature raising process performed when calculating the partial PM deposition amounts of the filter, when the filter is divided into three regions.
Figure 8C:
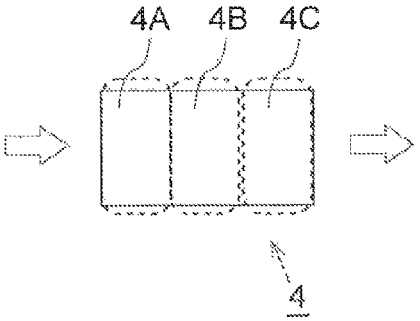
FIG. 8C shows the arrangement of the filter, when the filter is divided into three regions.

Next, calculation of the PM deposition amount in each region, in the case where the filter 4 is divided into three regions, i.e., a front region 4A, a center region 4B, and a rear region 4C, which are arranged along the flow of exhaust gas, will be described with reference to FIG. 8A, FIG. 8B, and FIG. 8C. The division of the filter 4 in this embodiment is illustrated in FIG. 8C. FIG. 8A shows changes in the temperature of each region with time during the calculation-time temperature raising process. In FIG. 8A, line L11 indicates changes in the temperature of the front region 4A with time, and line L12 indicates changes in the temperature of the center region 4B with time, while line L3 indicates changes in the temperature of the rear region 4C with time. As in the above-described embodiment, the ECU 20 estimates changes in the temperature of each region with time, based on the amount of heat supplied from the heater 3 to the filter 4, and various parameters relating to thermal propagation in the filter 4. FIG. 8B indicates changes in the detection value of the differential sensor 8 with time during the calculation-time temperature raising process.

More specifically, the calculation-time temperature raising process is started at time T11, and the temperature of the front region 4A located on the upstream side starts rising. At this time, most of the heat has not been transferred to the center region 4B and rear region 4C on the downstream side; therefore, the temperatures of the center region 4B and the rear region 4*b* undergo only minor changes. Then, at time T12, the temperature of the front region 4A reaches the oxidation start temperature Tpm. The temperature of the center region 4B starts gradually rising from around time T12, and reaches the oxidation start temperature Tpm at time T13. Further, the temperature of the rear region 4C starts gradually rising from around time T13, and reaches the oxidation start temperature Tpm at time T14. Then, at time T15, the calculation-time temperature raising process is completed, and the temperature of each region starts decreasing.

When the temperature of each region of the filter 4 changes in the above manner, and exceeds the oxidation start temperature Tpm, the PM deposited in the region is oxidized and burned, whereby the PM deposition state in the filter 4 changes, and the change is reflected by the exhaust differential pressure measured by the differential pressure sensor 8. More specifically, in the period of time T12 to time T13, the temperature of only the front region 4A exceeds the oxidation start temperature Tpm; therefore, only the PM deposited in this region is oxidized and burned, and the exhaust differential pressure is reduced by an amount of ΔdP_Fr. Also, in the period of time T13 to time T14, the temperatures of the front region 4A and the center region 4B exceed the oxidation start temperature Tpm. Thus, the PM deposited in these regions is oxidized and burned, and the exhaust differential pressure is reduced. The amount of reduction of the exhaust differential pressure due to oxidation and combustion of the deposited PM in the front region 4A in this period is denoted as ΔdP_Fr2, and the amount of reduction of the exhaust differential pressure due to oxidation and combustion of the deposited PM in the center region 4B is denoted as ΔdP_Ce. Thus, the amount of reduction of the exhaust differential pressure in the period of time T13 to time T14 is equal to the sum (ΔdP_Ce+ΔdP_Fr2) of both of the above-indicated reduction amounts.

Further, in the period of time T14 to time T15, the temperatures of all regions including the rear region 4C exceed the oxidation start temperature Tpm. Thus, the PM deposited in all of the regions is oxidized and burned, and the exhaust differential pressure is reduced. The amount of reduction of the exhaust differential pressure due to oxidation and combustion of the deposited PM in the front region 4A during this period is denoted as ΔdP_Fr3, and the amount of reduction of the exhaust differential pressure due to oxidation and combustion of the deposited PM in the center region 4B is denoted as ΔdP_Ce2, while the amount of reduction of the exhaust differential pressure due to oxidation and combustion of the deposited PM in the rear region 4C is denoted as ΔdP_Rr. Accordingly, the amount of reduction of the exhaust differential pressure in the period of time T14 to time T15 is equal to the sum (ΔdP_Rr+ΔdP_Ce2+ΔdP_Fr3) of these reduction amounts.

By using the first extraction method indicated in the above-described embodiment, ΔdP_Ce corresponding to the differential pressure reduction amount for the center region 4B, out of the reduction amount of the exhaust differential pressure in the period of time T13 to time T14, and ΔdP_Rr corresponding to the differential pressure reduction amount for the rear region 4C, out of the reduction amount of the exhaust differential pressure in the period of time T14 to time T15, are calculated. For example, when the period of time T12 to time T13, the period of time T13 to time T14, and the period of time T14 to time T15 have the same length of time, the amount of the deposited PM oxidized in each region during each period can be regarded as being substantially equal. Thus, ΔdP_Ce corresponding to the differential pressure reduction amount for the center region 4B is calculated by subtracting the reduction amount of the exhaust differential pressure in the period of time T12 to time T13 from the reduction amount of the exhaust differential pressure in the period of time T13 to time T14. Further, ΔdP_Rr corresponding to the differential pressure reduction amount for the rear region 4C is calculated by subtracting the reduction amount of the exhaust differential pressure in the period of time T13 to time T14 from the reduction amount of the exhaust differential pressure in the period of time T14 to time T15.

Then, the partial deposition amount in each region is calculated, according to the calculation logic described based on FIGS. 3A and 3B, based on ΔdP_Fr, ΔdP_Ce, ΔdP_Rr as the differential pressure reduction amounts corresponding to the respective regions, the length of the period of time T12 to time T13, the length of the period of time T13 to time T14, and the length of the period of time T14 to time T15. At this time, the partial deposition amount in the front region 4A is calculated so as to be larger as the proportion of the magnitude of ΔdP_Fr to the length of the period of time T12 to time T13 is larger, and the partial deposition amount in the center region 4B is calculated so as to be larger as the proportion of the magnitude of ΔdP_Ce to the length of the period of time T13 to time T14 is larger, while the partial deposition amount in the rear region 4C is calculated so as to be larger as the proportion of the magnitude of ΔdP_Rr to the length of the period of time T14 to time T15 is larger.

Even in the case where the filter 4 is divided into three regions as in this embodiment, and the partial deposition amount in each region is calculated, controls substantially corresponding to the first filter regeneration control, the second filter regeneration control, and the partial deposition amount estimation control as described in the first embodiment can be implemented, using the calculated partial deposition amounts. For example, when control corresponding to the first filter regeneration control is performed, the respective partial deposition amounts of the front region 4A, center region 4B and the rear region 4C may be compared with reference deposition amounts (threshold values of the PM deposition amounts corresponding to the first reference deposition amount Fr0, etc.) corresponding to the respective regions, so that the filter regeneration process can be executed early.

What is claimed is:

1. An exhaust emission control system of an internal combustion engine, the exhaust emission control system comprising:

a filter provided in an exhaust passage of the internal combustion engine, the filter being configured to trap particulate matter in exhaust gas, the filter including a first region as a part of the filter, and a second region as another part of the filter;

a heater configured to raise a temperature of the filter from an upstream side of the filter;

a differential pressure sensor configured to detect an exhaust pressure difference between the exhaust passage upstream of the filter and the exhaust passage downstream of the filter; and an electronic control unit configured to:

perform a prescribed temperature raising process by activating the heater to raise the temperature of the filter such that at least some of the particulate matter deposited in the first region and in the second region of the filter is oxidized, calculate a first differential pressure reduction in the exhaust pressure difference in a first oxidation period, wherein the first oxidation period includes at least a part of a period from a time at which a temperature of the first region exceeds a predetermined oxidation start temperature to a time at which a temperature of the second region exceeds the predetermined oxidation start temperature, the predetermined oxidation start temperature being a temperature at which oxidation of the particulate matter begins, and execute a filter regeneration process to oxidize the particulate matter in the filter based at least in part on the calculated first differential pressure reduction.

2. The exhaust emission control system according to claim 1, wherein, while performing the prescribed temperature raising process, the electronic control unit is further configured to calculate a first deposition amount of the particulate matter deposited in the first region based on the first oxidation period and the first differential pressure reduction.

3. The exhaust emission control system according to claim 2, wherein the calculated first deposition amount increases with an increase in a ratio of the first differential pressure reduction to the first oxidation period.

4. The exhaust emission control system according to claim 3, wherein, during execution of the prescribed temperature raising process, the electronic control unit is further configured to calculate a second differential pressure reduction in the exhaust pressure difference in a second oxidation period after the temperature of the second region exceeds the predetermined oxidation start temperature.

5. The exhaust emission control system according to claim 4, wherein the electronic control unit is further configured to calculate a second deposition amount of the particulate matter based on the second oxidation period and the second differential pressure reduction.

6. The exhaust emission control system according to claim 5, wherein the calculated second deposition amount increases with an increase in a ratio of a second region partial reduction amount to the second oxidation period, wherein the second region partial reduction amount includes a portion of the second differential pressure reduction corresponding to a differential pressure reduction for the second region.

7. The exhaust emission control system according to claim 6, wherein when the first oxidation period is set to a fixed length of time, the calculated first deposition amount increases with an increase in the first differential pressure reduction, and wherein when the second oxidation period is set to a fixed length of time, the calculated second deposition amount increases with an increase in the second region partial reduction amount.

8. The exhaust emission control system according to claim 6, wherein the electronic control unit is configured to set the second oxidation period such that the first oxidation period and the second oxidation period are about equal, and wherein the electronic control unit is configured to calculate the second region partial reduction amount based on a difference between the second differential pressure reduction and the first differential pressure reduction.

9. The exhaust emission control system according to claim 6, wherein the electronic control unit is configured to control the heater such that an amount of heat supplied to the filter per unit time in the first oxidation period is equal to an amount of heat supplied to the filter per unit time in the second oxidation period.

10. The exhaust emission control system according to claim 6, wherein the electronic control unit is configured to:

estimate an amount of the particulate matter deposited in the filter as a whole, based on operating conditions of the internal combustion engine, execute the filter regeneration process, when the amount of the particulate matter deposited in the filter as a whole exceeds a regeneration reference amount, execute the prescribed temperature raising process when the amount of the particulate matter deposited in the filter as a whole exceeds a partial calculation reference amount that is smaller than the regeneration reference amount, and execute the filter regeneration process even if the amount of the particulate matter deposited in the filter as a whole does not exceed the regeneration reference amount, when the first deposition amount exceeds a first reference deposition amount, or when the second deposition amount exceeds a second reference deposition amount.

11. The exhaust emission control system according to claim 6, wherein the electronic control unit is configured to:

estimate an amount of the particulate matter deposited in the filter as a whole, based on operating conditions of the internal combustion engine, execute the prescribed temperature raising process, when the amount of the particulate matter deposited in the filter as a whole exceeds a regeneration reference amount, and execute the filter regeneration process, following execution of the prescribed temperature raising process, when the first deposition amount does not exceed a third reference deposition amount, and the second deposition amount does not exceed a fourth reference deposition amount.

12. The exhaust emission control system according to claim 11, wherein the electronic control unit is configured to control the heater during a slow filter regeneration process, when at least the first deposition amount exceeds the third reference deposition amount, or the second deposition amount exceeds the fourth reference deposition amount, wherein in the slow filter regeneration process, an amount of heat supplied to the filter is smaller than that of the filter regeneration process.

13. The exhaust emission control system according to claim 6, wherein the electronic control unit is configured to:

estimate an estimated first deposition amount of the particulate matter deposited in the first region, and an estimated second deposition amount of the particulate matter deposited in the second region, based on operating conditions of the internal combustion engine, estimate an amount of the particulate matter deposited in the filter as a whole, based on operating conditions of the internal combustion engine, execute the filter regeneration process when the amount of the particulate matter deposited in the filter as a whole exceeds a regeneration reference amount, execute the prescribed temperature raising process when a predetermined time elapses from completion of the filter regeneration process, and correct the estimated first deposition amount and the estimated second deposition amount, based on the first deposition amount and the second deposition amount.

14. The exhaust emission control system according to claim 6, wherein the filter further includes a third region as a part of the filter located downstream of the second region, wherein, during execution of the prescribed temperature raising process, the electronic control unit is configured to:

set the second oxidation period such that the second oxidation period includes at least a part of a period from a time at which the temperature of the second region exceeds the predetermined oxidation start temperature, to a time at which a temperature of the third region exceeds the predetermined oxidation start temperature, calculate a third differential pressure reduction in the exhaust pressure difference in a third oxidation period after the temperature of the third region exceeds the predetermined oxidation start temperature, and calculate a third deposition amount of the particulate matter based on the third oxidation period and the third differential pressure reduction, wherein the calculated third deposition amount increases with an increase in a ratio of a third region partial reduction amount to the third oxidation period, and wherein the third region partial reduction amount includes a portion of the third differential pressure reduction corresponding to a differential pressure reduction for the third region.

* * * * *